US011668302B2

(12) United States Patent
Choi et al.

(10) Patent No.: US 11,668,302 B2
(45) Date of Patent: Jun. 6, 2023

(54) SCROLL COMPRESSOR HAVING OIL SUPPLY PASSAGES IN FLUID COMMUNICATION WITH COMPRESSION CHAMBERS

(71) Applicant: LG Electronics Inc., Seoul (KR)

(72) Inventors: Jungsun Choi, Seoul (KR); Kyungho Lee, Seoul (KR); Minho Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 17/552,939

(22) Filed: Dec. 16, 2021

(65) Prior Publication Data

US 2022/0260074 A1 Aug. 18, 2022

(30) Foreign Application Priority Data

Feb. 15, 2021 (KR) ..... 10-2021-0019972

(51) Int. Cl.
*F04C 18/02* (2006.01)
*F04C 2/02* (2006.01)
(Continued)

(52) U.S. Cl.
CPC ..... *F04C 18/0215* (2013.01); *F04C 2/025* (2013.01); *F04C 15/0088* (2013.01);
(Continued)

(58) Field of Classification Search
CPC ..... F04C 2/025; F04C 18/0207–0292; F04C 15/0088; F04C 15/0092;
(Continued)

(56) References Cited

U.S. PATENT DOCUMENTS 5,263,822 A 11/1993 Fujio
2013/0078131 A1* 3/2013 Ahn ..... F04C 18/0215 418/55.6
(Continued)

FOREIGN PATENT DOCUMENTS

EP 2574791 4/2013
JP H2011193789 7/1999
(Continued)

OTHER PUBLICATIONS

KR Office Action in Korean Appln. No. 10-2021-0019972, dated Feb. 16, 2022, 10 pages (with English translation).
(Continued)

*Primary Examiner* — Laert Dounis
(74) *Attorney, Agent, or Firm* — Fish & Richardson P.C.

(57) ABSTRACT

A scroll compressor includes a first oil supply passage communicating with a first compression chamber formed between an inner circumferential surface of a fixed wrap and an outer circumferential surface of an orbiting wrap, and a second oil supply passage separated from the first oil supply passage and communicating with a second compression chamber formed between an outer circumferential surface of the fixed wrap and an inner circumferential surface of the orbiting wrap, wherein the first oil supply passage includes an oil supply guide portion provided in a thrust surface of the fixed scroll in contact with the orbiting scroll to define a part of the first oil supply passage, whereby communication between the first and second compression chambers can be
(Continued)

prevented, thereby suppressing leakage between the compression chambers, stabilizing behavior of the orbiting scroll, and facilitating formation of the orbiting scroll.

19 Claims, 19 Drawing Sheets

(51) Int. Cl.
*F04C 15/00* (2006.01)
*F04C 29/02* (2006.01)
*F04C 23/00* (2006.01)

(52) U.S. Cl.
CPC ..... *F04C 18/0253* (2013.01); *F04C 23/008* (2013.01); *F04C 29/025* (2013.01); *F04C 29/028* (2013.01); *F04C 2240/30* (2013.01)

(58) Field of Classification Search
CPC .. F04C 29/02–028; F01C 1/0207–0292; F01C 21/04; F01C 21/045
See application file for complete search history.

(56) References Cited

U.S. PATENT DOCUMENTS

| | | | | |
|---|---|---|---|---|
| 2013/0216416 | A1* | 8/2013 | Takeda | F04C 18/0215 418/55.1 |
| 2014/0017108 | A1 | 1/2014 | Uekawa et al. | |
| 2014/0234148 | A1* | 8/2014 | Takeda | F04C 18/0269 418/55.2 |
| 2017/0306951 | A1 | 10/2017 | Chikano et al. | |
| 2021/0025395 | A1* | 1/2021 | Nagahara | F04C 18/0253 |

FOREIGN PATENT DOCUMENTS

| | | |
|---|---|---|
| JP | 2010090859 | 4/2010 |
| KR | 20190131838 | 11/2019 |

OTHER PUBLICATIONS

Extended European Search Report in European Appln. No. 21215269.8, dated Jun. 14, 2022, 7 pages.

* cited by examiner

SCROLL COMPRESSOR HAVING OIL SUPPLY PASSAGES IN FLUID COMMUNICATION WITH COMPRESSION CHAMBERS

CROSS-REFERENCE TO RELATED APPLICATION

Pursuant to 35 U.S.C. § 119(a), this application claims the benefit of the earlier filing date and the right of priority to Korean Patent Application No. 10-2021-0019972, filed on Feb. 15, 2021, the contents of which is incorporated by reference herein in its entirety.

TECHNICAL FIELD

This implementation relates to a scroll compressor, and more particularly, an oil supply structure of a scroll compressor.

BACKGROUND

A scroll compressor is a compressor forming a compression chamber including a suction chamber, an intermediate pressure chamber, and a discharge chamber between both scrolls while the plurality of scrolls is in an engaged state. Such a scroll compressor may obtain a relatively high compression ratio and stable torque by smooth connection of suction, compression, and discharge strokes of refrigerant, as compared with other types of compressors. Therefore, the scroll compressors are widely used for compressing refrigerant in air conditioners or the like.

Scroll compressors may be classified into a top-compression type and a bottom-compression type according to a position of a compression unit relative to a motor unit. The top-compression type is a compressor in which the compression unit is disposed above the motor unit, and the bottom-compression type is a compressor in which the compression unit is disposed below the motor unit.

In the top-compression type, since the compression unit is located far from a lower space of a casing, oil stored in the lower space of the casing is difficult to be moved to the compression unit. On the other hand, in the bottom-compression type, since the compression unit is located close to the lower space of the casing, the oil stored in the lower space of the casing can be easily moved to the compression unit. An implementation according to the present disclosure will illustrate a bottom-compression type scroll compressor. Therefore, hereinafter, a scroll compressor may be defined as a bottom-compression type scroll compressor unless otherwise specified.

The scroll compressor is provided with an oil supply portion for guiding oil stored in the lower space of the casing to the compression unit. The oil supply portion may supply oil using an oil pump or using differential pressure. An oil supplying method using the differential pressure can eliminate a component such as an oil pump, thereby reducing a fabricating cost and effectively supplying oil to the compression unit.

Prior Art 1 (Korean Patent Publication No. 10-2019-0131838) discloses an oil supply structure of a scroll compressor using differential pressure. The oil supply structure disclosed in Prior Art 1 includes oil supply holes formed through a fixed scroll to guide oil, which has been guided to an intermediate pressure chamber, to a compression chamber. The oil supply holes are formed to communicate with a first compression chamber formed between an inner surface of a fixed wrap and an outer surface of an orbiting wrap, and a second compression chamber formed between an outer surface of the fixed wrap and an inner surface of the orbiting wrap, respectively.

The oil supply hole communicating with the first compression chamber may be defined as a first oil supply hole and the oil supply hole communicating with the second compression chamber may be defined as a second oil supply hole. Prior Art 1 limits that the first oil supply hole and the second oil supply hole are respectively formed at positions where they are open before a suction completion time point of each compression chamber. As the oil supply holes individually communicate with the first compression chamber and the second compression chamber, smooth oil supply to both compression chambers can be expected even during a low-pressure ratio operation.

However, as disclosed in Prior Art 1, if the first oil supply hole communicating with the first compression chamber and the second oil supply hole communicating with the second compression chamber are provided, respectively, a section in which the first oil supply hole and the second oil supply hole communicate with each other may be generated due to the first and second oil supply holes being simultaneously open during an operation of the compressor. In the section where the first oil supply hole and the second oil supply hole communicate with each other, a part of refrigerant which is compressed in a compression chamber where pressure is high may flow back into a compression chamber where pressure is low due to such pressure difference between the first compression chamber and the second compression chamber. As a result, compression loss may occur due to leakage between the compression chambers. This may often occur in an operation of a low-pressure ratio which is less than 1.3.

In addition, when the first oil supply hole or the second oil supply hole is located too far from a center of a rotating shaft, strong pressure is applied to an orbiting scroll facing the first oil supply hole or the second oil supply hole when the first oil supply hole or the second oil supply hole is closed. Then, an overturning moment acting on the orbiting scroll increases, which makes the behavior of the orbiting scroll unstable. This causes an increase in leakage between compression chambers, thereby lowering compression efficiency.

In addition, a radial hole forming the first oil supply hole or the second oil supply hole is sealed with a blocking bolt. However, if an outlet of the first oil supply hole or the second oil supply hole is formed at a position close to an outer circumferential surface of the orbiting scroll, it is difficult to secure a coupling length of the blocking bolt, which may cause mass productivity to be degraded or reliability to be lowered.

SUMMARY

A first aspect of the present disclosure is to provide a scroll compressor, capable of suppressing compression loss in a first compression chamber formed between an inner surface of a fixed wrap and an outer surface of an orbiting wrap, and a second compression chamber formed between an outer surface of the fixed wrap and an inner surface of the orbiting wrap.

Further, the present disclosure provides a scroll compressor, capable of preventing a back flow of refrigerant from a high-pressure side compression chamber to a low-pressure side compression chamber through first and second oil supply passages while the first oil supply passage communicates with a first compression chamber and a second oil supply passage communicates with a second compression chamber, individually.

In addition, the present disclosure provides a scroll compressor, capable of preventing a first oil supply passage and a second oil supply passage from being simultaneously opened to corresponding compression chambers based on a crank angle, or capable of minimizing simultaneously opened crank angles.

A second aspect of the present disclosure is to provide a scroll compressor, capable of stabilizing behavior of an orbiting scroll by reducing an overturning moment acting on the orbiting scroll.

Furthermore, the present disclosure provides a scroll compressor, capable of forming a first oil supply passage or a second oil supply passage to be as close as possible to a center of a rotating shaft and simultaneously suppressing or minimizing the first oil supply passage and the second oil supply passage from communicating with corresponding compression chambers at the same time.

Further, the present disclosure provides a scroll compressor, capable of facilitating coupling of a blocking bolt and simultaneously enhancing reliability by forming a first oil supply passage or a second oil supply passage to be as far as possible from an outer circumferential surface of an orbiting scroll.

A third aspect of the present disclosure is to provide a scroll compressor, capable of preventing a first compression chamber and a second compression chamber from communicating with each other through oil supply passages while oil is smoothly supplied to the first compression chamber and the second compression chamber during a low-pressure ratio operation.

In order to achieve these and other advantages and in accordance with the purpose of this specification, as embodied and broadly described herein, there is provided a scroll compressor, in which an overlap section between a first crank angle range, in which a first oil supply passage is opened to a first compression chamber, and a second crank angle range, in which a second oil supply passage is opened to a second compressing chamber, is formed to be shorter than a non-overlap section between the first crank angle range and the second crank angle range. Accordingly, the overlap section between the first crank angle range and the second crank angle range can be reduced, thereby preventing communication between the first compression chamber and the second compression chamber and suppressing leakage between the compression chambers.

In addition, in order to achieve these and other advantages and in accordance with the purpose of this specification, as embodied and broadly described herein, there is provided a scroll compressor, in which a first oil supply passage communicating with a first compression chamber or a second oil supply passage communicating with a second compression chamber is formed through an orbiting scroll, an outlet of the first oil supply passage and an outlet of the second oil supply passage are spaced apart from a circumferential surface of an orbiting wrap, and a distance from an outer circumferential surface of the orbiting scroll to the outlet of the first oil supply passage is larger than a thickness of the orbiting wrap. With the configuration, the outlet of the first oil supply passage can be close to a center of the orbiting scroll so as to reduce an overturning moment and simultaneously can be spaced far apart from the outer circumferential surface of the orbiting scroll so as to secure a coupling length of a blocking bolt.

In addition, in order to achieve those aspects of the present disclosure, a main frame may be provided in an inner space of a casing. A fixed scroll may be coupled to one side of the main frame, and provided with a fixed end plate, and a fixed wrap formed on one side surface of the fixed end plate. An orbiting scroll may be provided between the main frame and the fixed scroll, and provided with an orbiting end plate facing the fixed end plate, and an orbiting wrap engaged with the fixed wrap to form a first compression chamber and a second compression chamber. A first oil supply passage may communicate with the first compression chamber formed between an inner circumferential surface of the fixed wrap and an outer circumferential surface of the orbiting wrap. A second oil supply passage may be separated from the first oil supply passage and communicate with the second compression chamber formed between an outer circumferential surface of the fixed wrap and an inner circumferential surface of the orbiting wrap. This may result in independently supplying oil to the first compression chamber and the second compression chamber.

In detail, the first oil supply passage may include an oil supply guide portion provided in a thrust surface of the fixed scroll in contact with the orbiting scroll so as to define a part of the first oil supply passage. Accordingly, the first oil supply passage can be moved toward the center of the orbiting scroll.

For example, the oil supply guide portion may be located in a range of a first virtual circle having a radius from a center of the fixed end plate to an outermost end of the fixed wrap. This may result in preventing the oil supply guide portion from being exposed to the outside of the orbiting end plate during an orbiting motion of the orbiting scroll or preventing a shortage of a sealing distance for the oil supply guide portion.

For example, the oil supply guide portion may be recessed into a thrust surface of the fixed scroll toward an outermost inner circumferential surface of the fixed wrap, such that an inner circumferential side of the oil supply guide portion communicates with the first compression chamber. With the configuration, an outlet of a first oil supply hole can be formed to correspond to the thrust surface and the first oil supply passage can communicate with the first compression chamber.

As an example, the oil supply guide portion may include an oil supply guide groove recessed in the thrust surface of the fixed scroll, and an oil supply guide hole formed through the fixed scroll inside the oil supply guide groove so as to communicate with the first compression chamber. This may allow a constant amount of oil to be stored in an oil supply passage, thereby supplying oil quickly when restarting the compressor.

For example, the first oil supply passage may include a first oil supply hole provided in the orbiting scroll to periodically communicate with the oil supply guide portion along an orbiting trajectory of the orbiting scroll. One end of the first oil supply hole facing the oil supply guide portion may be located within a range of a first virtual circle having a radius from a center of the fixed end plate to an outermost end of the fixed wrap during the orbiting motion of the orbiting scroll. With the configuration, the outlet of the first oil supply passage can be moved toward the center of the orbiting scroll so as to reduce an overturning moment and simultaneously secure a coupling length for a blocking bolt for sealing an outer circumferential end of the first oil supply passage.

For example, the oil supply guide portion may be formed in the thrust surface of the fixed end plate to have a radial length longer than a circumferential length. This may result in preventing an increase in a first oil supply section while securing a position at which the outlet of the first oil supply passage is moved toward the center of the orbiting scroll.

For example, the oil supply guide portion may include a first guide portion extending in a radial direction from the thrust surface of the fixed end plate, and a second guide portion extending in an intersecting direction with the radial direction so as to communicate with the first guide portion. This may result in securing an opening period to the first oil supply passage to correspond to an orbiting trajectory of a first oil supply hole, thereby enhancing the degree of freedom in designing a compression ratio.

For example, the first oil supply passage may include a first oil supply hole provided in the orbiting scroll to periodically communicate with the oil supply guide portion along an orbiting trajectory of the orbiting scroll. One end of the first oil supply hole facing the oil supply guide portion may be formed such that a second virtual circle connecting an orbiting trajectory of the first oil supply hole is located outside the first compression chamber. With the configuration, an overlap between a first oil supply section and a second oil supply section can be minimized and an outlet of the first oil supply passage can be as close as possible to the center of the orbiting scroll.

For example, the first oil supply passage may include a first oil supply hole provided in the orbiting scroll to periodically communicate with the oil supply guide portion along an orbiting trajectory of the orbiting scroll. One end of the first oil supply hole may be located such that a part of the second virtual circle connecting an orbiting trajectory of the first oil supply hole overlaps the inside of the first compression chamber. With the configuration, an amount of oil to be supplied to the first compression chamber can be secured while the outlet of the first oil supply hole is formed to correspond to the thrust surface.

For example, an interval between the first oil supply passage and the second oil supply passage may be larger than an interval from a suction completion angle to the oil supply guide portion. With the configuration, the overturning moment acting on the orbiting scroll can be reduced by increasing the interval between both oil supply passages.

For example, one end of the first oil supply passage may be located between an outer circumferential surface of the orbiting end plate and an outer circumferential surface of an outermost wrap of the orbiting wrap, and located within a range of a third virtual circle having a radius from a center of the orbiting end plate to an end of an outermost outer circumferential surface of the orbiting wrap. With the configuration, a distance from the outer circumferential surface of the orbiting scroll to the outlet of the first oil supply passage can extend, thereby reducing the overturning moment acting on the orbiting scroll and securing a coupling length for a blocking bolt.

As another example, the first oil supply passage may be provided with a connecting portion formed through the orbiting end plate in a radial direction, and an outlet portion penetrating through one side surface of the orbiting end plate facing the fixed end plate in a middle of the connecting portion. A distance from the outer circumferential surface of the orbiting end plate to the outlet portion may be larger than a wrap thickness of the orbiting wrap. With the configuration, a distance from the outer circumferential surface of the orbiting scroll to the outlet of the first oil supply passage can extend, thereby reducing the overturning moment acting on the orbiting scroll and securing a coupling length for a blocking bolt.

For example, when a section, in which a first oil supply section where the first oil supply passage communicates with the first compression chamber overlaps a second oil supply section where the second oil supply passage communicates with the second compression chamber, is defined as an overlap section, and a section in which the first oil supply section and the second oil supply section do not overlap each other is defined as a non-overlap section, the overlap section may be shorter than the non-overlap section. This may result in preventing leakage between the compression chambers through the first oil supply passage and the second oil supply passage, thereby enhancing compression efficiency.

In addition, in order to achieve those aspects of the present disclosure, a main frame may be provided in an inner space of a casing. A fixed scroll may be coupled to one side of the main frame, and provided with a fixed end plate, and a fixed wrap formed on one side surface of the fixed end plate. An orbiting scroll may be provided between the main frame and the fixed scroll, and provided with an orbiting end plate facing the fixed end plate, and an orbiting wrap engaged with the fixed wrap to form a first compression chamber and a second compression chamber. A first oil supply passage may communicate with the first compression chamber formed between an inner circumferential surface of the fixed wrap and an outer circumferential surface of the orbiting wrap. A second oil supply passage may be separated from the first oil supply passage and communicate with the second compression chamber formed between an outer circumferential surface of the fixed wrap and an inner circumferential surface of the orbiting wrap. At least one of the first oil supply passage and the second oil supply passage may be formed sequentially through the main frame and the fixed scroll. When a section, in which a first oil supply section where the first oil supply passage communicates with the first compression chamber overlaps a second oil supply section where the second oil supply passage communicates with the second compression chamber is defined as an overlap section, and a section in which the first oil supply section and the second oil supply section do not overlap each other is defined as a non-overlap section, the overlap section may be shorter than the non-overlap section. This may result in facilitating formation of the orbiting scroll, stabilizing behavior of the orbiting scroll, and preventing leakage between the compression chambers through the first oil supply passage and the second oil supply passage, thereby enhancing compression efficiency.

For example, the first oil supply passage may communicate with the first compression chamber at a crank angle at which the second oil supply passage is blocked from the second compression chamber. This may result in preventing the leakage between the compression chambers through the first oil supply passage and the second oil supply passage, thereby further enhancing compression efficiency.

In addition, in order to achieve those aspects of the present disclosure, a main frame may be provided in an inner space of a casing. A fixed scroll may be coupled to one side of the main frame, and provided with a fixed end plate, and a fixed wrap formed on one side surface of the fixed end plate. An orbiting scroll may be provided between the main frame and the fixed scroll, and provided with an orbiting end plate facing the fixed end plate, and an orbiting wrap engaged with the fixed wrap to form a first compression chamber and a second compression chamber. A first oil supply passage may communicate with the first compression chamber formed between an inner circumferential surface of the fixed wrap and an outer circumferential surface of the orbiting wrap. A second oil supply passage may be separated from the first oil supply passage and communicate with the second compression chamber formed between an outer circumferential surface of the fixed wrap and an inner circumferential surface of the orbiting wrap. When a section, in which a first oil supply section where the first oil supply passage communicates with the first compression chamber overlaps a second oil supply section where the second oil supply passage communicates with the second compression chamber, is defined as an overlap section, and a section in which the first oil supply section and the second oil supply section do not overlap each other is defined as a non-overlap section, the overlap section may be shorter than the non-overlap section. This may result in preventing leakage between the compression chambers through the first oil supply passage and the second oil supply passage, thereby enhancing compression efficiency.

For example, the first oil supply passage may communicate with the first compression chamber at a crank angle at which the second oil supply passage is blocked from the second compression chamber. This may result in preventing leakage between the compression chambers through the first oil supply passage and the second oil supply passage, thereby further enhancing compression efficiency.

For example, the first oil supply passage may include a first oil supply hole penetrating through an inside of the orbiting scroll, and an oil supply guide portion provided in a thrust surface of the fixed scroll facing one end of the first oil supply hole so as to define a part of the first oil supply passage. The oil supply guide portion may be located in a range of a first virtual circle having a radius from a center of the fixed end plate to an outermost end of the fixed wrap. With the configuration, the outlet of the first oil supply passage can be moved toward the center of the orbiting scroll so as to reduce an overturning moment, and simultaneously secure a coupling length for a blocking bolt for sealing an outer circumferential end of the first oil supply passage.

DETAILED DESCRIPTION

Description will now be given in detail of a scroll compressor according to exemplary embodiments disclosed herein, with reference to the accompanying drawings. In implementations disclosed herein, a description will be given by defining an axial direction and a radial direction based on a rotating shaft. That is, for the sake of explanation, a longitudinal direction of a rotating shaft is defined as an axial direction (or gravity direction) of a compressor, and a transverse direction of the rotating shaft is defined as a radial direction of the compressor.

In addition, a description will be given of a bottom-compression type scroll compressor which is a vertical type scroll compressor with a motor unit and a compression unit arranged in a vertical direction in a manner that the compression unit is located below the motor unit. In addition, a description will be given of an example of a high-pressure type scroll compressor which is a bottom-compression type and has a refrigerant suction pipe directly connected to the compression unit and a refrigerant discharge pipe communicating with an inner space of a casing. Therefore, unless otherwise specified, a scroll compressor will be understood as a high-pressure and bottom-compression type scroll compressor.

Figure 1:
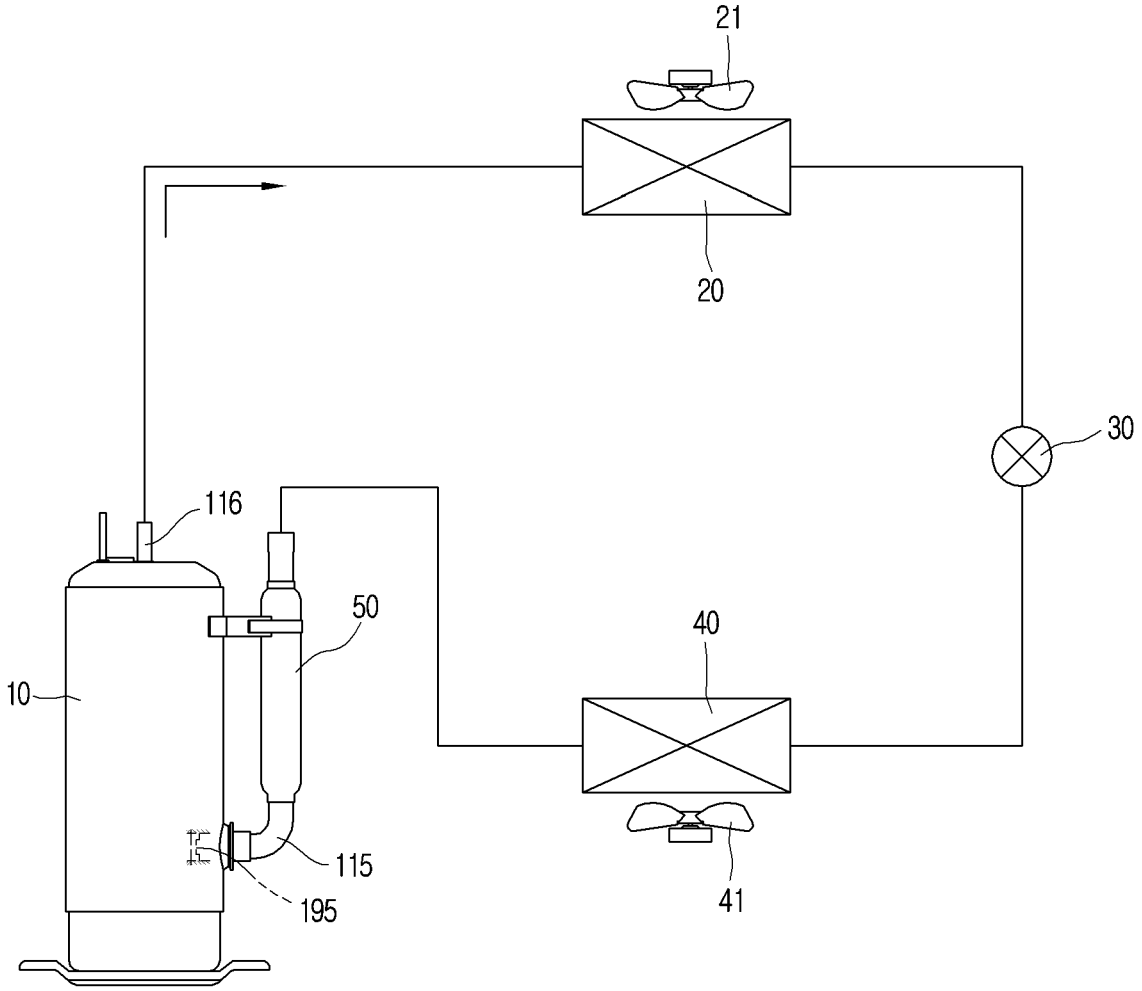
FIG. 1 is a diagram illustrating a refrigeration cycle apparatus to which a bottom-compression type scroll compressor in accordance with one implementation of the present disclosure is applied.

FIG. 1 is a diagram illustrating a refrigeration cycle apparatus to which a bottom-compression type scroll compressor in accordance with one implementation of the present disclosure is applied.

Referring to FIG. 1, a refrigeration cycle apparatus to which the scroll compressor according to the implementation is applied may be configured such that a compressor 10, a condenser 20, an expansion apparatus 30, and an evaporator 40 define a closed loop. The condenser 20, the expansion apparatus 30, and the evaporator 40 may be sequentially connected to a discharge side of the compressor 10 and a discharge side of the evaporator 40 may be connected to a suction side of the compressor 10. Accordingly, refrigerant compressed in the compressor 10 may be discharged toward the condenser 20, and then sucked back into the compressor 10 sequentially through the expansion apparatus 30 and the evaporator 40. The series of processes may be repeatedly carried out.

Figure 2:
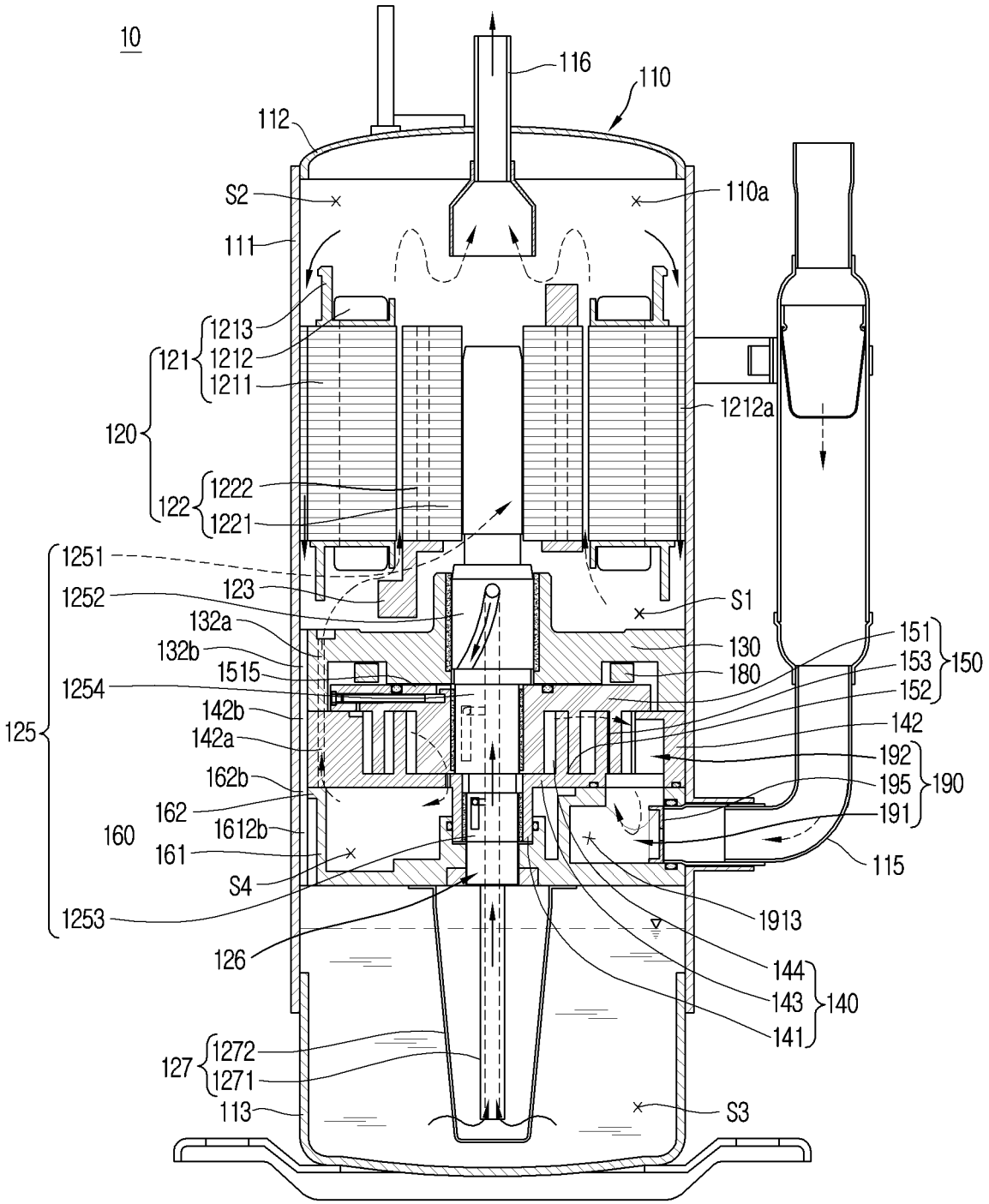
FIG. 2 is a longitudinal sectional view of a bottom-compression type scroll compressor in accordance with an implementation.
Figure 3:
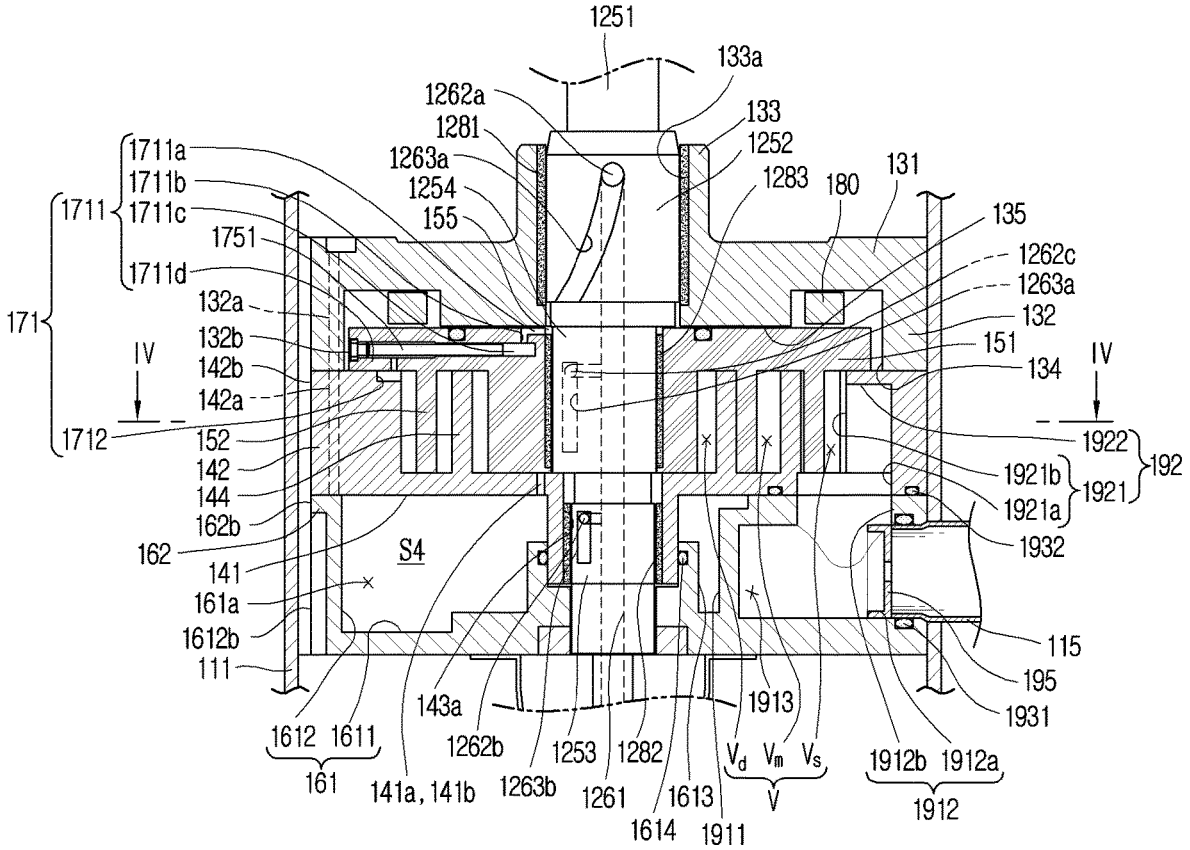
FIG. 3 is an enlarged longitudinal sectional view of a compression unit in FIG. 2.
Figure 4:
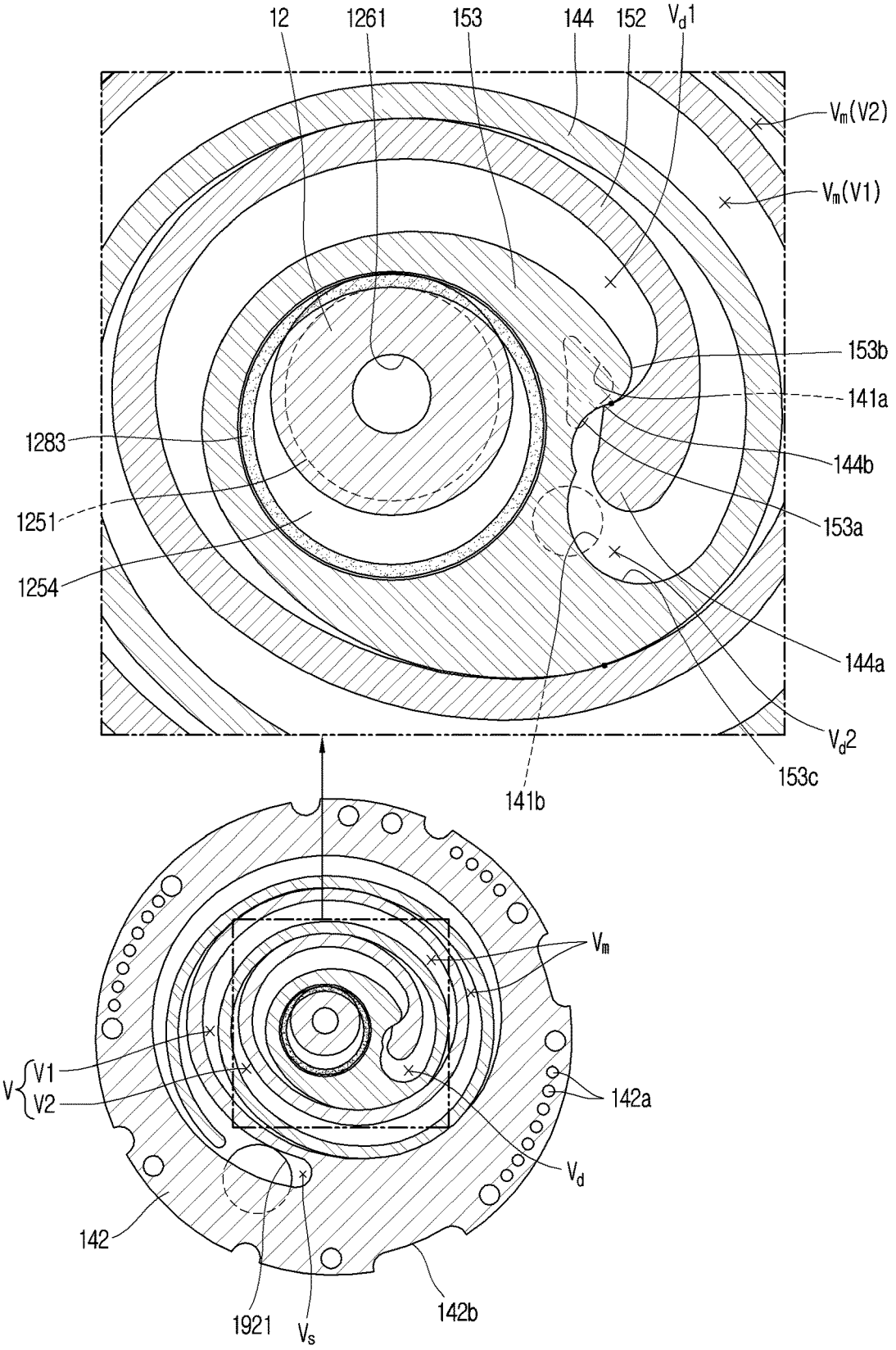
FIG. 4 is a sectional view taken along the line "IV-IV" of FIG. 3.

FIG. 2 is a longitudinal view illustrating a bottom-compression type scroll compressor in accordance with an implementation of the present disclosure, FIG. 3 is an enlarged longitudinal view illustrating a compression unit in FIG. 2, and FIG. 4 is a sectional view taken along the line "IV-IV" of FIG. 3.

Referring to FIGS. 2 to 4, a scroll compressor according to an implementation may include a driving motor 120 disposed in an upper half portion of a casing 110, and a main frame 130, an orbiting scroll 150, a fixed scroll 140, and a discharge cover 160 sequentially disposed below the driving motor 120. In general, the driving motor 120 may constitute a motor unit, and the main frame 130, the fixed scroll 140, the orbiting scroll 150, and the discharge cover 160 may constitute a compression unit.

The motor unit may be coupled to an upper end portion of a rotating shaft 125 to be explained later, and the compression unit may be coupled to a lower end portion of the rotating shaft 125. Accordingly, the compressor 10 may have the bottom-compression type structure described above, and the compression unit may be connected to the motor unit by the rotating shaft 125 to be operated by a rotational force of the motor unit.

Referring to FIG. 2, the casing 110 according to the implementation may define appearance of the compressor and include a cylindrical shell 111, an upper shell 112, and a lower shell 113. The cylindrical shell 112 may be formed in a cylindrical shape with upper and lower ends open. The upper shell 112 may be coupled to cover the opened upper end of the cylindrical shell 111. The lower shell 113 may be coupled to cover the opened lower end of the cylindrical shell 111. Accordingly, the inner space 110*a* of the casing 110 may be sealed. The sealed inner space 110*a* of the casing 110 may be divided into a lower space S1 and an upper space S2 based on the driving motor 120. An oil storage space S3 may be separately defined below the lower space S1 based on the compression unit. The lower space S1 may define a discharge space, and the upper space S2 may define an oil separation space.

The driving motor 120 and the main frame 130 may be fixedly inserted into the cylindrical shell 111. An outer circumferential surface of the driving motor 120 and an outer circumferential surface of the main frame 130 may be spaced apart from an inner circumferential surface of the cylindrical shell 111 by a preset interval, thereby defining an oil recovery passage Po. This will be described again later together with the oil recovery passage.

A refrigerant suction pipe 115 may be coupled through a side surface of the cylindrical shell 111. Accordingly, the refrigerant suction pipe 115 may be coupled through the cylindrical shell 111 forming the casing 110 in a radial direction.

The refrigerant suction pipe 115 may be formed in an L-like shape. One end of the refrigerant suction pipe 115 may be coupled through the cylindrical shell 111 so as to communicate directly with a first suction passage 1912 of the discharge cover 160 to be explained later, which defines a compression unit. In other words, the refrigerant suction pipe 115 may be connected to a suction passage 190 to be described later at a position lower than a compression chamber V in an axial direction. Accordingly, in this implementation, as the suction passage 190 is formed in the oil storage space S3 which is an empty space below the compression unit, a suction check valve 195 to be described later may be disposed to operate in the axial direction in a bottom-compression manner, without extending a length of the compressor.

Another end of the refrigerant suction pipe 115 may be connected to an accumulator 50 outside the cylindrical shell 111. The accumulator 50 may be connected to an outlet side of the evaporator 40 through a refrigerant pipe. Accordingly, while refrigerant flows from the evaporator 40 to the accumulator 50, liquid refrigerant may be separated in the accumulator 50, and only gaseous refrigerant may be directly introduced into the compression chamber V through the refrigerant suction pipe 115.

A terminal bracket (not shown) may be coupled to an upper portion of the cylindrical shell 111 or the upper shell 112, and a terminal (not shown) for transmitting external power to the driving motor 120 may be coupled through the terminal bracket.

A refrigerant discharge pipe 116 may be coupled through an upper portion of the upper shell 112 to communicate with the inner space 110*a* of the casing 110. The refrigerant discharge pipe 116 may correspond to a passage through which compressed refrigerant discharged from the compression unit to the inner space 110*a* of the casing 110 is externally discharged toward the condenser 20.

The refrigerant discharge pipe 116 may be provided therein with an oil separator (not shown) for separating oil from refrigerant discharged from the compressor 10 to the condenser 20, or a check valve (not shown) for suppressing refrigerant discharged from the compressor 10 from flowing back into the compressor 10.

Hereinafter, a driving motor constituting the motor unit will be described.

Referring to FIG. 2, the driving motor 120 according to the implementation may include a stator 121 and a rotor 122. The stator 121 may be fixed onto the inner circumferential surface of the cylindrical shell 111, and the rotor 122 may be rotatably disposed in the stator 121.

The stator 121 may include a stator core 1211 and a stator coil 1212.

The stator core 1211 may be formed in a cylindrical shape and may be shrink-fitted onto the inner circumferential surface of the cylindrical shell 111. A plurality of recessed surfaces may be formed in a D-cut shape recessed into an outer circumferential surface of the stator core 1211 along the axial direction, and disposed at preset intervals along a circumferential direction.

The recessed surfaces 1211*a* may be spaced apart from the inner circumferential surface of the cylindrical shell 111 to define a first oil recovery passage (not shown) through which oil passes. Accordingly, oil separated from refrigerant in the upper space S2 may move to the lower space S1 through the first oil recovery passage, and then return into the oil storage space S3 through a second oil recovery passage (no reference numeral given).

The stator coil 1212 may be wound around the stator core 1211 and may be electrically connected to an external power source through a terminal (not shown) that is coupled through the casing 110. An insulator 1213, which is an insulating member, may be inserted between the stator core 1211 and the stator coil 1212.

The insulator 1213 may extend long to both sides in the axial direction to accommodate a bundle of the stator coil 1212 in the radial direction, and a portion of the insulator 1213 which extends downwardly may configure an oil separation portion (no reference numeral given) to prevent refrigerant discharged into the lower space S1 from being mixed with oil recovered from the upper space S2.

The rotor 122 may include a rotor core 1221 and permanent magnets 1222.

The rotor core 1221 may be formed in a cylindrical shape, and may be rotatably inserted into the stator core 1211 with a preset gap therebetween. The permanent magnets 1222 may be embedded in the rotor core 1222 at preset intervals along a circumferential direction.

In addition, a balance weight 123 may be coupled to a lower end of the rotor core 1221. Alternatively, the balance weight 123 may be coupled to a shaft portion 1251 of a rotating shaft 125 to be described later.

The rotating shaft 125 may be coupled to the center of the rotor 122. An upper end portion of the rotating shaft 125 may be press-fitted into the rotor 122, and a lower end portion may be rotatably inserted into the main frame 130 to be supported in the radial direction.

The main frame 130 may be provided with a main bearing 1281 configured as a bush bearing to support the lower end portion of the rotating shaft 125. Accordingly, the rotating shaft 125 may transfer the rotational force of the motor unit 120 to the orbiting scroll 150 of the compression unit 30. Accordingly, the orbiting scroll 150 eccentrically coupled to the rotating shaft 125 may perform an orbiting motion with respect to the fixed scroll 140.

Referring to FIG. 2, the rotating shaft 125 may include a main shaft portion 1251, a first bearing shaft portion 1252, a second bearing shaft portion 1253, and an eccentric shaft portion 1254.

The shaft portion 1251 may be a portion constituting the upper half of the rotating shaft 125. The main shaft portion 1251 may be formed in a solid cylindrical shape, and the rotor 122 may be press-fitted into an upper portion of the main shaft portion 1251.

The first bearing shaft portion 1252 may be a portion extending from a lower end of the main shaft portion 1251. The first bearing shaft portion 1252 may be inserted into a main bearing hole 133*a* of the main frame 130 to be described later so as to be supported in the radial direction.

The second bearing shaft portion 1253 may be a portion corresponding to a lower end of the main shaft portion 1251. The second bearing shaft portion 1253 may be inserted into a sub bearing hole 143*a* of the fixed scroll 140 to be described later so as to be supported in the radial direction. The second bearing shaft portion 1253 may be coaxially disposed with respect to the first bearing shaft portion 1252 so as to have the same axial center.

The eccentric shaft portion 1254 may be formed between a lower end of the first bearing shaft portion 1252 and an upper end of the second bearing shaft portion 1253. The eccentric shaft portion 1254 may be inserted into a rotating shaft coupling portion 333 of the orbiting scroll 150 to be described later.

The eccentric shaft portion 1254 may be eccentric with respect to the first bearing shaft portion 1252 or the second bearing shaft portion 1253 in the radial direction. Accordingly, when the rotating shaft 125 rotates, the orbiting scroll 150 may perform an orbiting motion with respect to the fixed scroll 140.

Meanwhile, the rotating shaft 125 may include an oil supply passage 126 formed therein to supply oil to the first bearing shaft portion 1252, the second bearing shaft portion 1252, and the eccentric shaft portion 1254. The oil passage 126 may include an inner oil passage 1261 formed in the rotating shaft along the axial direction.

As the compression unit is located below the motor unit 20, the inner oil passage 1261 may be formed in a grooving manner from the lower end of the rotating shaft 125 approximately to a lower end or a middle height of the stator 121 or up to a position higher than an upper end of the first bearing shaft portion 1252. Of course, in some cases, the inner oil passage 1261 may also be formed through the rotating shaft 125 in the axial direction.

In addition, an oil pickup 127 for pumping up oil filled in the oil storage space S3 may be coupled to the lower end of the rotating shaft 125, namely, a lower end of the second bearing shaft portion 1253. The oil pickup 127 may include an oil suction pipe 1271 inserted into the inner oil passage 1261 of the rotating shaft 125, and a blocking member 1272 accommodating the oil supply pipe 1271 to block an introduction of foreign materials. The oil suction pipe 1271 may extend downward through the discharge cover 160 to be immersed in the oil filled in the oil storage space S3.

The rotating shaft 125 may be provided with a plurality of oil holes 1262*a*, 1262*b*, and 1262*c* communicating with the inner oil passage 1261 to guide oil moving upward along the inner oil passage 1261 toward the first and second bearing shaft portions 1252 and 1253 and the eccentric shaft portion 1254.

The plurality of oil holes 1262*a*, 1262*b*, and 1262*c* may penetrate from an inner circumferential surface of the inner oil passage 1261 to outer circumferential surfaces of the bearing shaft portions 1252 and 1253 and the eccentric shaft portion 1254. The plurality of oil holes may constitute the oil passage 126 together with the inner oil passage 1261, and include a first oil hole 1262*a*, a second oil hole 1262*b*, and a third oil hole 1262*c*.

The first oil hole 1262*a* may be formed from the inner circumferential surface of the inner oil passage 1261 to the outer circumferential surface of the first bearing shaft portion 1252 in a penetrating manner, and the second oil hole 1262*b* may be formed from the inner circumferential surface of the inner oil passage 1261 to the outer circumferential surface of the second bearing shaft portion 1253 in a penetrating manner, and the third oil hole 1262*c* may be formed from the inner circumferential surface of the inner oil passage 1261 to the outer circumferential surface of the eccentric shaft portion 1254 in a penetrating manner. In other words, the second oil hole 1262*b*, the third oil hole 1262*c*, and the first oil hole 1262*a* may be sequentially formed from the lower end to the upper end of the rotating shaft 125.

In addition, a first oil groove 1263*a* may be formed on the outer circumferential surface of the first bearing shaft portion 1252. The first oil groove 1263*a* may communicate with the inner oil passage 1261 through the first oil hole 1262*a*. A second oil groove 1263*b* may be formed on the second bearing shaft portion 1253 of the rotating shaft 125. The second oil groove 1263*b* may communicate with the inner oil passage 1261 through the second oil hole 1262*b*.

In addition, a third oil groove 1263*c* may be formed on the outer circumferential surface of the eccentric shaft portion 1254. The third oil groove 1263*c* may communicate with the inner oil passage 1261 through the third oil hole 1262*c*. Accordingly, oil may be spread evenly on the outer circumferential surfaces of the bearing shaft portions 1252 and 1253 and the eccentric shaft portion 1254 to lubricate each bearing surface.

Here, the oil moving to the first oil groove 1263*a* of the first bearing shaft portion 1252 or the oil moving to the third oil groove 1263*c* of the eccentric shaft portion 1254 may flow to an oil accommodating portion 155 to be described later. And, this oil may be supplied to the compression chamber through an oil supply passage 170 provided in the orbiting scroll 150 to be described later. One oil supply passage 170 may be formed to alternately communicate with both of the compression chambers V1 and V2, or a plurality of oil supply passages 170 may be formed independently to communicate with both of the compression chambers V1 and V2, respectively. This implementation illustrates the plurality of oil supply passages 171 and 172, which will be described again later.

Figure 5:
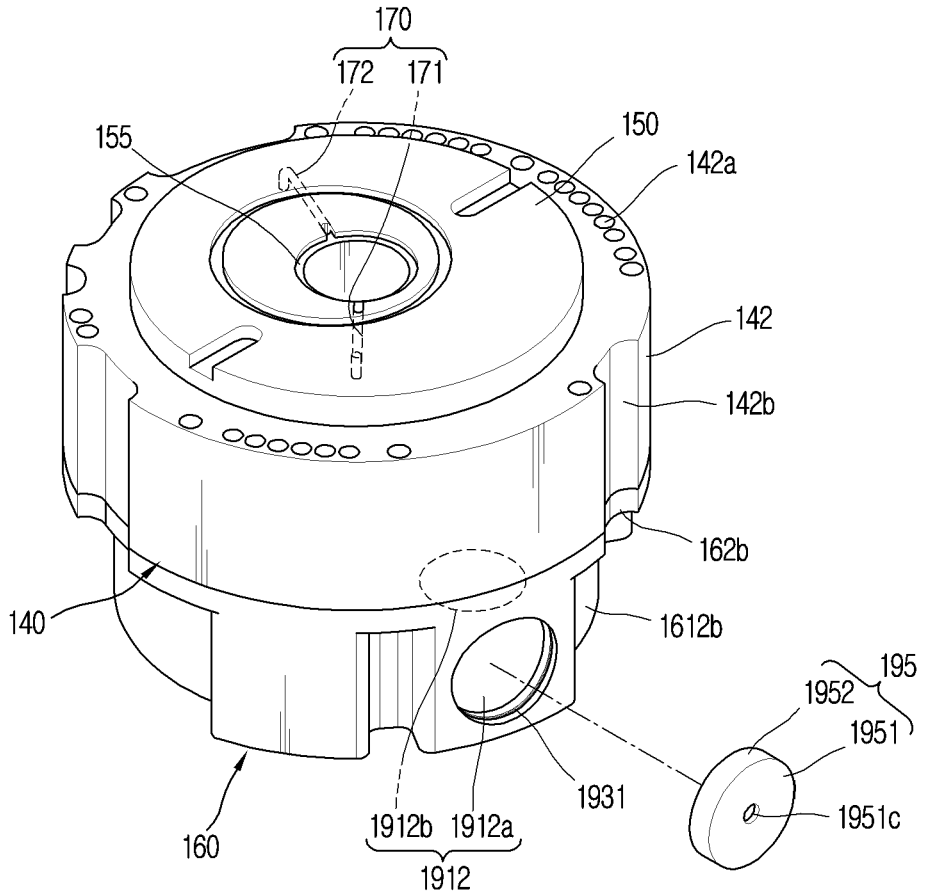
FIG. 5 is an enlarged sectional view illustrating a part of a compression unit in accordance with an implementation of the present disclosure.

Hereinafter, the compression unit will be described. FIG. 5 is an assembled perspective view illustrating a part of a compression unit in accordance with an implementation, FIG. 6 is an exploded perspective view of the part of the compression unit according to FIG. 5, viewed from the top, and FIG. 7 is an exploded perspective view of the part of the compression unit according to FIG. 5, viewed from the bottom.

Figure 6:
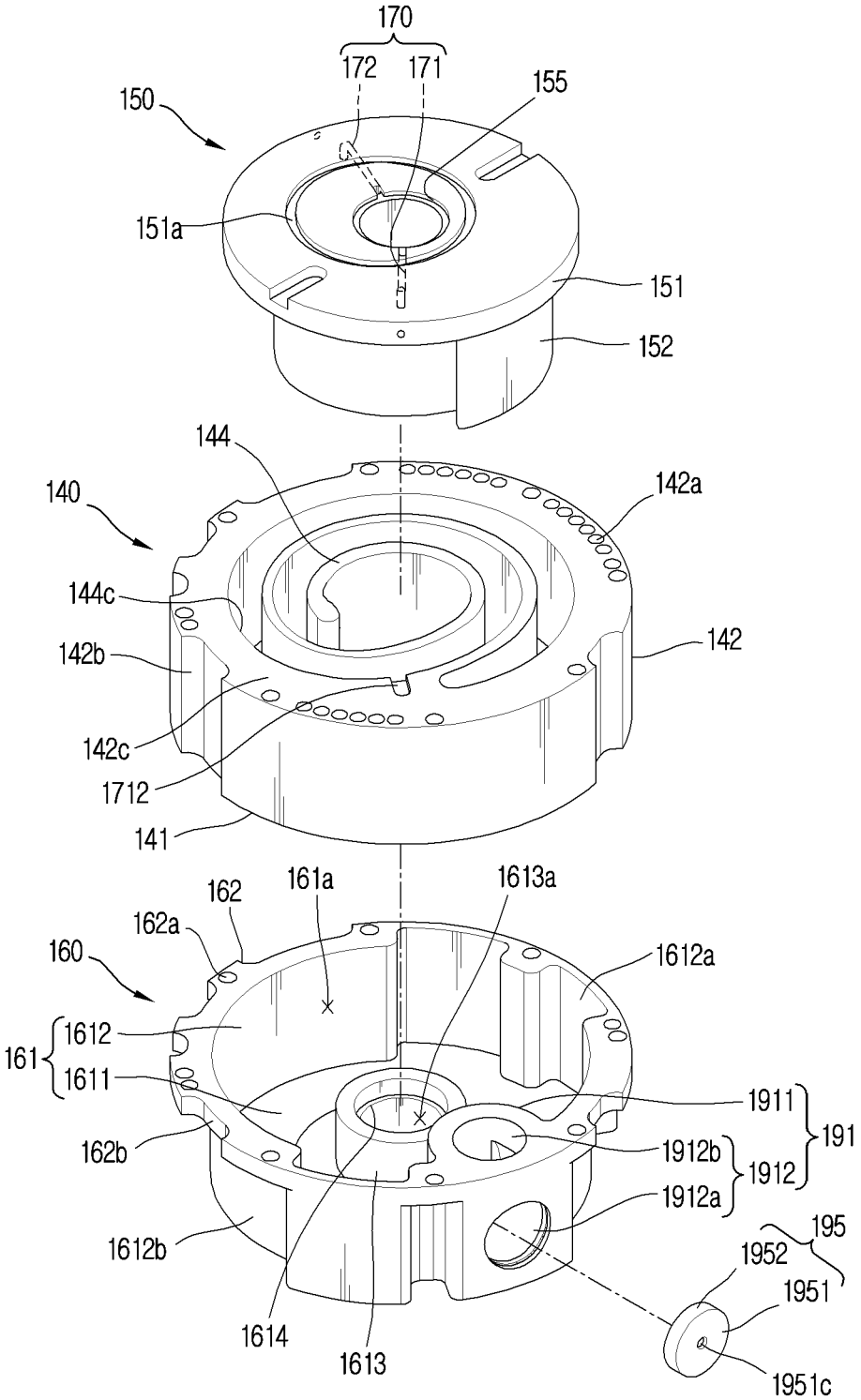
FIG. 6 is an exploded perspective view of the part of the compression unit according to FIG. 5, viewed from the top.
Figure 7:
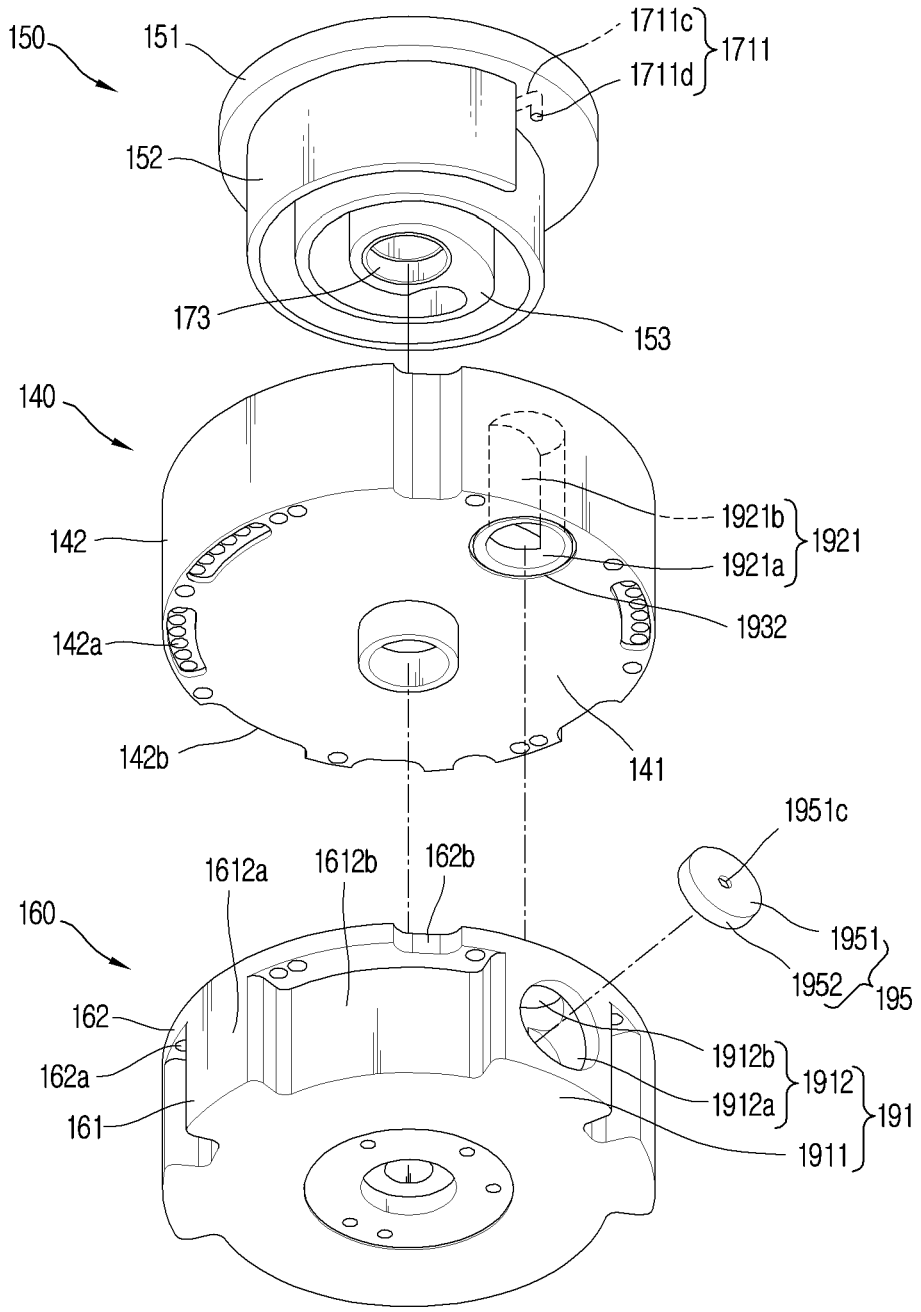
FIG. 7 is an exploded perspective view of the part of the compression unit according to FIG. 5, viewed from the bottom.

Referring to FIGS. 5 to 7, the main frame 130 according to the implementation may include a frame end plate 131, a frame side wall portion 132, a main bearing portion 133, a scroll accommodating portion 134, and a scroll support portion 135.

The frame end plate 131 may be formed in an annular shape and installed below the driving motor 120. Accordingly, the lower space S1 of the casing 110 may be separated from the oil storage space S3 by the frame end plate 131.

The frame side wall portion 132 may extend in a cylindrical shape from an edge of a lower surface of the frame end plate 131, and an outer circumferential surface of the frame side wall portion 132 may be fixed to the inner circumferential surface of the cylindrical shell 111 in a shrink-fitting or welding manner.

A scroll accommodating portion 134 to be explained later may formed inside the frame side wall portion 132. The orbiting scroll 150 to be described later may be accommodated in the scroll accommodating portion 134 so as to perform an orbiting motion. To this end, an inner diameter of the frame side wall portion 132 may be greater than an outer diameter of an orbiting end plate 151 to be described later.

A plurality of frame discharge holes 132*a* may be formed at the frame side wall portion 132. The plurality of frame discharge holes 132*a* may be formed through the frame side wall portion 132 in the axial direction and disposed at preset intervals along a circumferential direction.

The frame discharge holes (hereinafter, referred to as second discharge holes) 132*a* may be formed to correspond to scroll discharge holes 142*a* of the fixed scroll 140 to be described later, and define a first refrigerant discharge passage (no reference numeral given) together with the scroll discharge holes 142*a*.

Also, a plurality of frame oil recovery grooves (hereinafter, referred to as first oil recovery grooves) 132*b* may be formed on an outer circumferential surface of the frame side wall portion 132 with the second discharge holes 132*a* interposed therebetween. The plurality of first oil recovery grooves 132*b* may be formed in the axial direction at preset intervals along the circumferential direction.

The first oil recovery grooves 132*b* may be formed to correspond to scroll oil recovery grooves 142*b* of the fixed scroll 140, which will be described later, and define a second oil recovery passage together with the scroll oil recovery grooves 142*b* of the fixed scroll 140.

The main bearing portion 133 may protrude upward from an upper surface of a central portion of the frame end plate 131 toward the driving motor 120. The main bearing portion 133 may be provided with a main bearing hole 133*a* formed therethrough in a cylindrical shape along the axial direction. A main bearing 1281 configured as a bush bearing may be firmly fitted onto an inner circumferential surface of the main bearing hole 133*a*. The main bearing portion 133 of the rotating shaft 125 may be fitted onto the main bearing 1281 to be supported in the radial direction.

The scroll accommodating portion 134 may be a space defined by a lower surface of the frame end plate 131 and the inner circumferential surface of the frame side wall portion 132. An orbiting end plate 151 of the orbiting scroll 150 to be described later may be supported in the axial direction by the lower surface of the frame end plate 131, and accommodated in the frame side wall portion 132 in a manner that its outer circumferential surface is spaced apart from the inner circumferential surface of the frame side wall portion 132 by a preset interval (for example, an orbiting radius). Accordingly, the inner diameter of the frame side wall portion 132 constituting the scroll accommodating portion 134 may be greater than the outer diameter of the orbiting end plate 151 by the orbiting radius or more.

In addition, the frame side wall portion 132 defining the scroll accommodating portion 134 may have a height (depth) that is greater than or equal to a thickness of the orbiting end plate 151. Accordingly, while the frame side wall portion 132 is supported on the upper surface of the fixed scroll 140, the orbiting scroll 150 may perform an orbiting motion in the scroll accommodating portion 134.

The scroll support portion 135 may be formed in an annular shape on the lower surface of the frame end plate 131 that faces the orbiting end plate 151 of the orbiting scroll 150 to be described later. Accordingly, an Oldham ring 180 may be pivotably inserted between an outer circumferential surface of the scroll support portion 135 and the inner circumferential surface of the frame side wall portion 132.

In addition, the scroll support portion 135 may have a lower surface formed flat, so that a back pressure sealing member 1515 provided on the orbiting end plate 151 of the orbiting scroll 150 to be described later is in contact with the lower surface in a sliding manner.

The back pressure sealing member 1515 may be formed in an annular shape, thereby defining an oil accommodating portion 155 between the scroll support portion 135 and the orbiting end plate 151. Accordingly, oil flowing into the oil accommodating portion 155 through the third oil hole 1262*c* of the rotating shaft 125 may be introduced into the compression chamber V through the compression chamber oil supply hole 170 of the orbiting scroll 150 to be described later.

Hereinafter, the fixed scroll will be described.

Referring to FIGS. 5 to 7 again, the fixed scroll 140 according to the implementation may include a fixed end plate 141, a fixed side wall portion 142, a sub bearing portion 143, and a fixed wrap 144.

The fixed end plate 141 may be formed approximately in a disk shape, and a sub bearing hole 143*a* forming the sub bearing portion 143 to be described later may be formed through a center of the fixed end plate 141 in the axial direction. Discharge ports 141*a* and 141*b* may be formed around the sub bearing hole 143*a*. The discharge ports 141*a* and 141*b* may communicate with a discharge chamber Vd so that compressed refrigerant is moved into a discharge space S4 of the discharge cover 160 to be explained later.

Only one discharge port 141*a*, 141*b* may be provided to communicate with both of a first compression chamber V1 and a second compression chamber V2 to be described later. In the illustrated implementation, however, the first discharge port 141*a* may communicate with the first compression chamber V1 and the second discharge port 141*b* may communicate with the second compression chamber V2. Accordingly, refrigerant compressed in the first compression chamber V1 and refrigerant compressed in the second compression chamber V2 may be independently discharged through the different discharge ports.

The fixed side wall portion 142 may extend in an annular shape from an edge of an upper surface of the fixed end plate 141 in the axial direction. The fixed side wall portion 142 may be coupled to face the frame side wall portion 132 of the main frame 130 in the axial direction.

A plurality of scroll discharge holes (hereinafter, referred to as first discharge holes) 142*a* may be formed through the fixed side wall portion 142 in the axial direction and communicate with the frame discharge holes 132*a* to define the first refrigerant discharge passage together with the frame discharge holes 132*a*.

Scroll oil recovery grooves (hereinafter, referred to as second oil recovery grooves) 142*b* may be formed on the outer circumferential surface of the fixed side wall portion 142. The second oil recovery grooves 142*b* may communicate with the first oil recovery grooves 132*b* provided at the main frame 130 to guide oil recovered along the first oil recovery grooves 132*b* to the oil storage space S3. Accordingly, the first oil recovery grooves 132*b* and the second oil recovery grooves 142*b* may define the second oil recovery passage together with oil recovery grooves 1612*b* and 162*b* of a flange portion 160 to be described later.

Meanwhile, a second suction passage 1921 may be formed in the fixed side wall portion 142 to communicate with a first suction passage 1912 formed in the discharge cover 160 to be described later. The second suction passage 1921 may define a part of a suction port. Accordingly, the second suction passage 1921 may be formed within the range of the suction chamber Vs so as to communicate with the suction chamber Vs of the compression unit. The suction passage including the second suction passage will be described later.

The sub bearing portion 143 may extend in the axial direction from a central portion of the fixed end plate 141 toward the discharge cover 160. The sub bearing portion 143 may be provided with a sub bearing hole 143*a* formed in a cylindrical shape through a center thereof along the axial direction. A sub bearing 1282 configured as a bush bearing may be fitted onto an inner circumferential surface of the sub bearing hole 143*a*.

Therefore, the lower end (or bearing portion) of the rotating shaft 125 may be inserted into the sub bearing portion 143 of the fixed scroll 140 to be supported in the radial direction, and the eccentric shaft portion 1254 of the rotating shaft 125 may be supported by the upper surface of the fixed end plate 141 defining the surrounding of the sub bearing portion 143.

A fixed wrap 144 may extend from the upper surface of the fixed end plate 141 toward the orbiting scroll 150 in the axial direction. The fixed wrap 144 may be engaged with an orbiting wrap 152 to be described later to define the compression chamber V. The fixed wrap 144 will be described later together with the orbiting wrap 152.

Hereinafter, the orbiting scroll will be described.

Referring to FIGS. 5 to 7, the orbiting scroll 150 according to the implementation may include an orbiting end plate 151, an orbiting wrap 152, and a rotating shaft coupling portion 153.

The orbiting end plate 151 may be formed approximately in a disk shape. A back pressure sealing groove 151*a* into which the back pressure sealing member 1515 is inserted may be formed in an upper surface of the orbiting end plate 151. The back pressure sealing groove 151*a* may be formed at a position facing the scroll support portion 135 of the main frame 130.

The back pressure sealing groove 151*a* may be formed in an annular shape to surround a rotating shaft coupling portion 153 to be described later, and may be eccentric with respect to an axial center of the rotating shaft coupling portion 153. Accordingly, even if the orbiting scroll 150 performs an orbiting motion, a back pressure chamber (no reference numeral given) having a constant range may be defined between the orbiting scroll 150 and the scroll support portion 135 of the main frame 130.

The orbiting wrap 152 may extend from the lower surface of the orbiting end plate 151 toward the fixed scroll 140 and engage with the fixed wrap 144 to form a compression chamber V. The orbiting wrap 152 may be formed in an involute shape together with the fixed wrap 144. However, the orbiting wrap 152 and the fixed wrap 144 may be formed in various shapes other than the involute shape.

Referring back to FIG. 4, the orbiting wrap 152 may be formed in a substantially elliptical shape in which a plurality of arcs having different diameters and origins is connected and the outermost curve may have a major axis and a minor axis. The fixed wrap 144 may also be formed in a similar manner.

An inner end portion of the orbiting wrap 152 may be formed at a central portion of the orbiting end plate 151, and the rotating shaft coupling portion 153 may be formed through the central portion of the orbiting end plate 151 in the axial direction.

The eccentric shaft portion 1254 of the rotating shaft 125 may be rotatably inserted into the rotating shaft coupling portion 153. An outer circumferential part of the rotating shaft coupling portion 153 may be connected to the orbiting wrap 152 to form the compression chamber V together with the fixed wrap 144 during a compression process.

The rotating shaft coupling portion 153 may be formed at a height at which it overlaps the orbiting wrap 152 on the same plane. That is, the rotating shaft coupling portion 153 may be disposed at a height at which the eccentric shaft portion 1254 of the rotating shaft 125 overlaps the orbiting wrap 152 on the same plane. Accordingly, repulsive force and compressive force of refrigerant may cancel each other while being applied to the same plane based on the orbiting end plate 151, and thus inclination of the orbiting scroll 150 due to interaction between the compressive force and the repulsive force may be suppressed.

In addition, the rotating shaft coupling portion 153 may be provided with a concave portion 153*a* that is formed on an outer circumferential surface thereof, namely, an outer circumferential surface facing an inner end portion of the fixed wrap 144, to be engaged with a protruding portion 144*a* of the fixed wrap 144. As a result, a wrap thickness at the inner end portion of the fixed wrap 144, which is subjected to the strongest compressive force on the fixed wrap 144, may increase so as to enhance strength of the fixed wrap 144.

A convex portion 153*b* may be formed at one side of the concave portion 153*a*. The convex portion 153*b* may be formed at an upstream side along a direction in which the compression chamber V is formed, and have a thickness increasing from an inner circumferential surface to an outer circumferential surface of the rotating shaft coupling portion 153. This may extend a compression path of the first compression chamber V1 immediately before discharge, and the compression ratio of the first compression chamber V1 can be increased close to a pressure ratio of the second compression chamber V2. The first compression chamber V1 is a compression chamber formed between an inner surface of the fixed wrap 144 and an outer surface of the orbiting wrap 152, and will be described later separately from the second compression chamber V2.

At another side of the concave portion 153*a* is formed an arcuate compression surface 153*c* having an arcuate shape. As a result, a wrap thickness of the orbiting wrap around the arcuate compression surface 153*c* may increase to ensure durability of the orbiting wrap 152 and thus the compression path may extend to increase the compression ratio of the second compression chamber V2 to that extent.

On the other hand, the compression chamber V may be formed in a space defined by the fixed end plate 141, the fixed wrap 144, the orbiting end plate 151, and the orbiting wrap 152. The compression chamber V may include a first compression chamber V1 formed between an inner surface of the fixed wrap 144 and an outer surface of the orbiting wrap 152, and a second compression chamber V2 formed between an outer surface of the fixed wrap 144 and an inner surface of the orbiting wrap 152.

In each of the first compression chamber V1 and the second compression chamber V2, a suction chamber Vs, an intermediate pressure chamber Vm, and a discharge chamber Vd may be continuously formed from outside to inside along an advancing direction of the wraps. The intermediate pressure chamber Vm and the discharge chamber Vd may be independently formed for each of the first compression chamber V1 and the second compression chamber V2. Accordingly, the first discharge port 141*a* may communicate with a discharge chamber Vd1 of the first compression chamber V1 and the second discharge port 141*b* may communicate with a discharge chamber Vd2 of the second compression chamber V2.

On the other hand, the suction chamber Vs may be formed to be shared by the first compression chamber V1 and the second compression chamber V2. That is, the suction chamber Vs may be formed at an outer side than the orbiting wrap 152 based on the advancing direction of the wrap.

Specifically, the suction chamber Vs may be defined as a space formed in an area that the end of the orbiting wrap 152 does not reach, namely, outside an orbiting range of the orbiting wrap 152, in a space formed between the inner circumferential surface of the fixed side wall portion 142 and an outer surface of the outermost fixed wrap 144 extending from the fixed side wall portion 142. Accordingly, the second suction passage 1921 to be described later may penetrate through the fixed end plate 141 in the axial direction to communicate with the suction chamber Vs.

On the other hand, an eccentric shaft bearing 1283 which is configured as a bush bearing may be fitted to the inner circumferential surface of the rotating shaft coupling portion 153, and the eccentric shaft portion 1254 of the rotating shaft 125 may be rotatably inserted into the eccentric shaft bearing 1283. Accordingly, the eccentric shaft portion 1254 of the rotating shaft 125 may be supported by the eccentric shaft bearing 1283 in the radial direction so as to perform a smooth orbiting motion relative to the orbiting scroll 150.

Here, the oil accommodating portion 155 for storing oil moving along the oil passage 126 described above may be formed in the inner circumferential surface of the rotating shaft coupling portion 153. A part of an oil supply passage 170 may be formed in the orbiting end plate 151 and communicate with the oil accommodating portion 155 to guide the oil stored in the oil accommodating portion 155 to the first compression chamber V1 and the second compression chamber V2. The oil accommodating portion 155 may be a single annular groove. The oil supply passage 170 may include a first oil supply passage 171 communicating with the first compression chamber V1, and a second oil supply passage 172 communicating with the second compression chamber V2.

Referring to FIGS. 5 and 6, the oil accommodating portion 155 according to the implementation may be formed as an annular groove in an upper side of the eccentric shaft bearing 1283.

For example, an axial length of the eccentric shaft bearing 1283 may be shorter than an axial length (height) of the rotating shaft coupling portion 153. Accordingly, a space corresponding to a difference in length between the eccentric shaft bearing 1283 and the rotating shaft coupling portion 153 and the thickness of the eccentric shaft bearing 1283 may be formed in an upper end of the eccentric shaft bearing 1283. This space may communicate with the third oil hole 1262*c* or the first oil hole 1262*a* of the rotating shaft 125 to define the oil accommodating portion 155.

In other words, the oil accommodating portion 155 which is formed as the annular groove may have a lower surface defined by an upper surface of the eccentric shaft bearing 1283, an outer circumferential surface defined by the inner circumferential surface of the rotating shaft coupling portion 153, an inner circumferential surface defined by the outer circumferential surface of the rotating shaft 125, and an upper surface defined by the lower surface of the main frame 130.

Referring to FIGS. 5 to 7, the oil supply passage 170 according to the implementation, as aforementioned, may include the first oil supply passage 171 communicating with the first compression chamber V1, and the second oil supply passage 172 communicating with the second communication chamber V2.

An inlet of the first oil supply passage 171 and an inlet of the second oil supply passage 172 may communicate with the inner circumferential surface of the oil accommodating portion 155, respectively, and an outlet of the first oil supply passage 171 and an outlet of the second oil supply passage 172 may communicate with the first compression chamber V1 and the second compression chamber V2, respectively. Accordingly, the inlets of the first oil supply passage 171 and the second oil supply passage 172 may communicate with each other, but the outlets of the first and second oil supply passages 171 and 172 may be separated from each other so as to define different oil supply passages.

Specifically, the outlet of the first oil supply passage 171 and the outlet of the second oil supply passage 172 may penetrate through the lower surface of the orbiting end plate 151 at a time point when suction in each compression chamber V1 and V2 is completed, namely, at a rotating angle of the orbiting wrap 152 greater than a rotating angle of the orbiting wrap 152, at which the suction in each compression chamber V1 and V2 is completed.

Accordingly, the outlets of the first oil supply passage 171 and the second oil supply passage 172 may be located at a downstream side more than the suction check valve 195 based on a direction that refrigerant is sucked. Accordingly, when the compressor is stopped, oil which is intended to flow back toward the refrigerant suction pipe 115 through the first oil supply passage 171 and the second oil supply passage 172 may be blocked by the suction check valve 195, thereby preventing oil leakage from the compression chambers V1 and V2 toward the refrigerant suction pipe 115. The first oil supply passage 171 and the second oil supply passage 172 will be described later.

Hereinafter, the discharge cover will be described.

Referring back to FIGS. 5 to 7, the discharge cover 160 may include a cover housing portion 161 and a cover flange portion 162. The cover housing portion 161 may have a cover space 161*a* therein defining the discharge space together with the fixed scroll 140.

The cover housing portion 161 may include a housing bottom surface 1611 and a housing side wall surface 1612 extending in the axial direction from the housing bottom surface 1611 to have a substantially annular shape.

Accordingly, the housing bottom surface 1611 and the housing side wall surface 1612 may define the cover space 161*a* for accommodating the outlets of the discharge ports 141*a* and 141*b* provided in the fixed scroll 140 and the inlet of the first discharge hole 142*a*, and the cover space 161*a* may define the discharge space S4 together with a surface of the fixed scroll 140 inserted into the cover space 161*a*.

A cover bearing protrusion 1613 may protrude from a central portion of the housing bottom surface 1611 toward the fixed scroll 140 in the axial direction, and a through hole 1613*a* may be formed through the inside of the cover bearing protrusion 1613 in the axial direction.

The sub bearing portion 143 that protrudes from the rear surface of the fixed scroll 140, namely, from the fixed end plate 141 in a downward direction (the axial direction) may be inserted into the through hole 1613*a*. A cover sealing member 1614 for sealing a gap between an inner circumferential surface of the through hole 1613*a* and an outer circumferential surface of the sub bearing portion 143 may be inserted into the gap.

The housing side wall surface 1612 may extend outward from an outer circumferential surface of the cover housing portion 161 so as to be coupled in close contact with the lower surface of the fixed scroll 140. In addition, at least one discharge guide groove 1612*a* may be formed on an inner circumferential surface of the housing side wall surface 1612 along the circumferential direction.

The discharge guide groove 1612*a* may be recessed outward in the radial direction, and the first discharge hole 142*a* of the fixed scroll 140 defining a first refrigerant discharge passage may be formed to be positioned inside the discharge guide groove 1612*a*. Accordingly, an inner surface of the housing side wall surface 1612 excluding the discharge guide groove 1612*a* may be brought into close contact with the outer circumferential surface of the fixed scroll 140, namely, the outer circumferential surface of the fixed end plate 141 so as to configure a type of sealing part.

Here, an entire circumferential angle of the discharge guide groove 1612*a* may be formed to be smaller than or equal to an entire circumferential angle with respect to an inner circumferential surface of the discharge space S4 except for the discharge guide groove 1612*a*. In this manner, the inner circumferential surface of the discharge space S4 except for the discharge guide groove 1612*a* can secure not only a sufficient sealing area but also a circumferential length for forming the cover flange portion 162 to be described later.

The housing side wall surface 1612 may be provided with oil recovery grooves 1612*b* formed on an outer circumferential surface thereof with a preset interval along the circumferential direction so as to define a third oil recovery groove. For example, the oil recovery groove 1612*b* may be formed on the outer circumferential surface of the housing side wall surface 1612. The oil recovery grooves 1612*b* may define the third oil recovery groove together with oil recovery grooves 162*b* of the cover flange portion 162 to be described later. The third oil recovery groove of the discharge cover 160 may define the second oil recovery passage together with the first oil recovery groove of the main frame 130 and the second oil recovery groove of the fixed scroll 140.

The cover flange portion 162 may extend radially from a portion defining the sealing part, namely, from an outer circumferential surface of a portion, excluding the discharge guide groove 1612*a*, of the housing side wall surface 1612 of the cover housing portion 161.

The cover flange portion 162 may be provided with coupling holes 162*a* for coupling the discharge cover 160 to the fixed scroll 140 with bolts, and a plurality of oil recovery grooves 162*b* formed between the neighboring coupling holes 162*a* at preset intervals in the circumferential direction.

The oil recovery grooves 162*b* formed on the cover flange portion 162 may define the third oil recovery groove together with the oil recovery groove 1612*b* formed on the housing side wall surface 1612. The oil recovery grooves 162*b* formed on the cover flange portion 162 may be recessed inward (toward a center) in the radial direction from an outer circumferential surface of the cover flange portion 162.

Meanwhile, the first suction passage 1912 may be formed in the discharge cover 160, and the refrigerant suction pipe 115 may communicate with the second suction passage 1921 of the fixed scroll 140 through the first suction passage 1912. The refrigerant suction pipe 115 inserted through the cylindrical shell 111 may be inserted into an inlet of the first suction passage 1912 so as to communicate directly with the first suction passage 1912. An outlet of the first suction passage 1912 may communicate with the second suction passage 1921 of the fixed scroll 140.

The first suction passage 1912 may be provided with a suction check valve 195 for selectively opening and closing the suction passage 190 which includes the first suction passage 1912 and the second suction passage 1921. The suction check valve 195 may also be referred to as a suction passage check valve, a suction valve, or a check valve.

The suction check valve 195 may be provided between the refrigerant suction pipe 115 and the first suction passage 1912 to allow a fluid movement from the refrigerant suction pipe 115 to the second suction passage 1912 while blocking a reverse fluid movement from the first suction passage 1912 to the refrigerant suction pipe 115.

Accordingly, during the operation of the compressor, refrigerant sucked through the refrigerant suction pipe 115 may be introduced into the suction chamber Vs through the suction passage 190 including the first suction passage 1912 and the second suction passage 1921. On the other hand, when the compressor is stopped, the suction check valve 195 may close the suction passage 190 so that high-temperature oil contained in the oil storage space S3 of the casing 110 can be prevented from flowing back into the refrigerant suction pipe 115 together with high-temperature refrigerant compressed in the compression chamber V. The suction passage 190 including the first suction passage 1912 and the suction check valve 195 will be described later.

In the drawings, unexplained reference numeral 21 denotes a condenser fan, and 41 denotes an evaporator fan.

Hereinafter, an operation of the high-pressure and bottom-compression type scroll compressor according to the implementation will be described.

That is, when power is applied to the motor unit 120, rotational force may be generated and the rotor 22 and the rotating shaft 50 may rotate accordingly. As the rotating shaft 50 rotates, the orbiting scroll 35 eccentrically coupled to the rotating shaft 50 may perform an orbiting motion by the Oldham ring 140.

Accordingly, the volume of the compression chamber V may gradually decrease from a suction chamber Vs formed at an outer side of the compression chamber V toward an intermediate pressure chamber Vm continuously formed toward a center and a discharge chamber Vd in a central portion.

Then, refrigerant may move to the accumulator 50 sequentially via the condenser 20, the expansion apparatus 30, and the evaporator 40 of the refrigeration cycle. The refrigerant may flow toward the suction chamber Vs forming the compression chamber V through the refrigerant suction pipe 115.

The refrigerant sucked into the suction chamber Vs may be compressed while moving to the discharge chamber Vd via the intermediate pressure chamber Vm along a movement trajectory of the compression chamber V. The compressed refrigerant may be discharged from the discharge chamber Vd to the discharge space S4 of the discharge cover 60 through the discharge ports 141*a* and 141*b*.

The refrigerant discharged into the discharge space S4 of the discharge cover 160 may then flow into the inner space 110*a* of the casing 110 through the discharge guide groove 1612*a* of the discharge cover 160 and the first discharge holes 142*a* of the fixed scroll 140. The refrigerant may flow to the lower space S1 between the main frame 130 and the driving motor 120 and then move toward the upper space S2 of the casing 110, which is defined above the driving motor 120, through a gap between the stator 121 and the rotor 122.

However, oil may be separated from the refrigerant in the upper space S2 of the casing 110, and the oil-separated refrigerant may be discharged to the outside of the casing 110 through the refrigerant discharge pipe 116 so as to flow to the condenser 20 of the refrigeration cycle.

On the other hand, the oil separated from the refrigerant in the inner space 110*a* of the casing 110 may be recovered into the oil storage space S3 defined in the lower portion of the compression unit through the first oil recovery passage between the inner circumferential surface of the casing 110 and the stator 121 and the second oil recovery passage between the inner circumferential surface of the casing 110 and the outer circumferential surface of the compression unit. This oil may thusly be supplied to each bearing surface (not shown) through the oil passage 126, and partially supplied into the compression chamber V. The oil supplied to the bearing surface and the compression chamber V may be discharged to the discharge cover 160 together with the refrigerant and recovered. This series of processes may be repeatedly performed.

On the other hand, when the compressor 10 is stopped, the refrigeration cycle including the compressor 10 may perform an operation to enter a so-called pressure equilibrium state. For example, immediately after the compressor 10 is stopped, the interior of the compressor 10 may be divided into a high-pressure region and a low-pressure region based on the compression chamber. That is, while the inner space 110*a* of the casing 110 is still maintained in a discharge pressure state, a suction pressure state may be maintained around the outlet side of the refrigerant suction pipe 115.

At this time, in the high-pressure scroll compressor in which the refrigerant suction pipe 115 directly communicates with the compression chamber V, oil or refrigerant filled in the inner space 110*a* of the casing 110 may flow back toward the refrigerant suction pipe 115 while the pressure equalization operation is in progress in the stopped state of the compressor. The back flow of the oil or refrigerant occurs much more prominently in the bottom-compression type scroll compressor in which the compression unit is disposed below the driving motor 120 to be adjacent to the oil storage space S3.

However, the back flow of the oil or refrigerant may be suppressed by the suction check valve 195 that is installed in the middle of the suction passage 190, for example, in the middle between the first suction passage 1912 and the second suction passage 1921 so as to configure a kind of check valve. The suction check valve 195 may block the suction passage 190 when the compressor is stopped, thereby preventing the oil or refrigerant in the casing 110 from flowing back toward the suction passage 190 through the compression unit.

In this way, in the scroll compressor of the high-pressure type and the bottom-compression type, as the suction check valve is installed between an outlet of the refrigerant suction pipe and an inlet of the compression unit, the oil or refrigerant in the casing can be quickly prevented from flowing back to the refrigerant suction pipe through the compression unit when the compressor is stopped. In addition, upon the restart of the compressor, an increase in a specific volume of the refrigerant can be suppressed and friction loss due to a shortage of oil can be reduced, thereby improving compression efficiency.

As the suction check valve is operated in the axial direction, the structure of the suction check valve can be simplified, which may result in reducing a fabricating cost and simultaneously improving responsiveness of the valve, thereby enhancing the compression efficiency.

In addition, as the suction passage is formed in the discharge cover or the fixed scroll, the suction passage may be formed in an oil storage space located below the compression unit, so that the compressor can be reduced in size while maintaining its axial length.

On the other hand, as described above, when different oil supply passages (for example, the first oil supply passage and a second oil supply passage) are formed to communicate individually with the first and second compression chambers V1 and V2, at least one of the different oil supply paths may be opened toward the corresponding compression chamber.

In particular, oil supply sections in which the oil supply passages are open to the corresponding compression chambers, respectively, (for example, a first oil supply section in which the first oil supply passage is opened to the first compression chamber and a second oil supply section in which the second oil supply passage is opened to the second compression chamber) may overlap each other in a preset crank angle range.

That is, the first oil supply section As1 in which the first oil supply passage 171 is opened and the second oil supply section As2 in which the second oil supply passage 172 is opened may have an overlap section. Then, even if the orbiting scroll 150 performs the orbiting motion during the operation of the compressor, at least one of the oil supply passages 171 and 172 may be opened to supply oil to the compression chamber V1, V2, which may result in preventing friction loss between the fixed scroll 140 and the orbiting scroll 150 which form the compression chamber.

However, when the first oil supply section and the second oil supply section overlap each other within the preset crank angle range, it may be advantageous in terms of oil supply but may be disadvantageous in terms of compression efficiency. For example, when a pressure difference between the first compression chamber V1 and the second compression chamber V2 occurs, a phenomenon in which refrigerant compressed in a high-pressure side partially flows back to a low pressure-side may occur in the section where the first oil supply section As1 and the second oil supply section As2 overlap each other. As a result, compression loss may be increased and compression efficiency may be decreased.

Thus, in the implementation, the first oil supply passage 171 communicating with the first compression chamber V1 and the second oil supply passage 172 communicating with the second compression chamber V2 may be provided independently of each other, such that the both compression chambers do not communicate with each other through the first oil supply passage 171 and the second oil supply passage 172.

Figure 8:
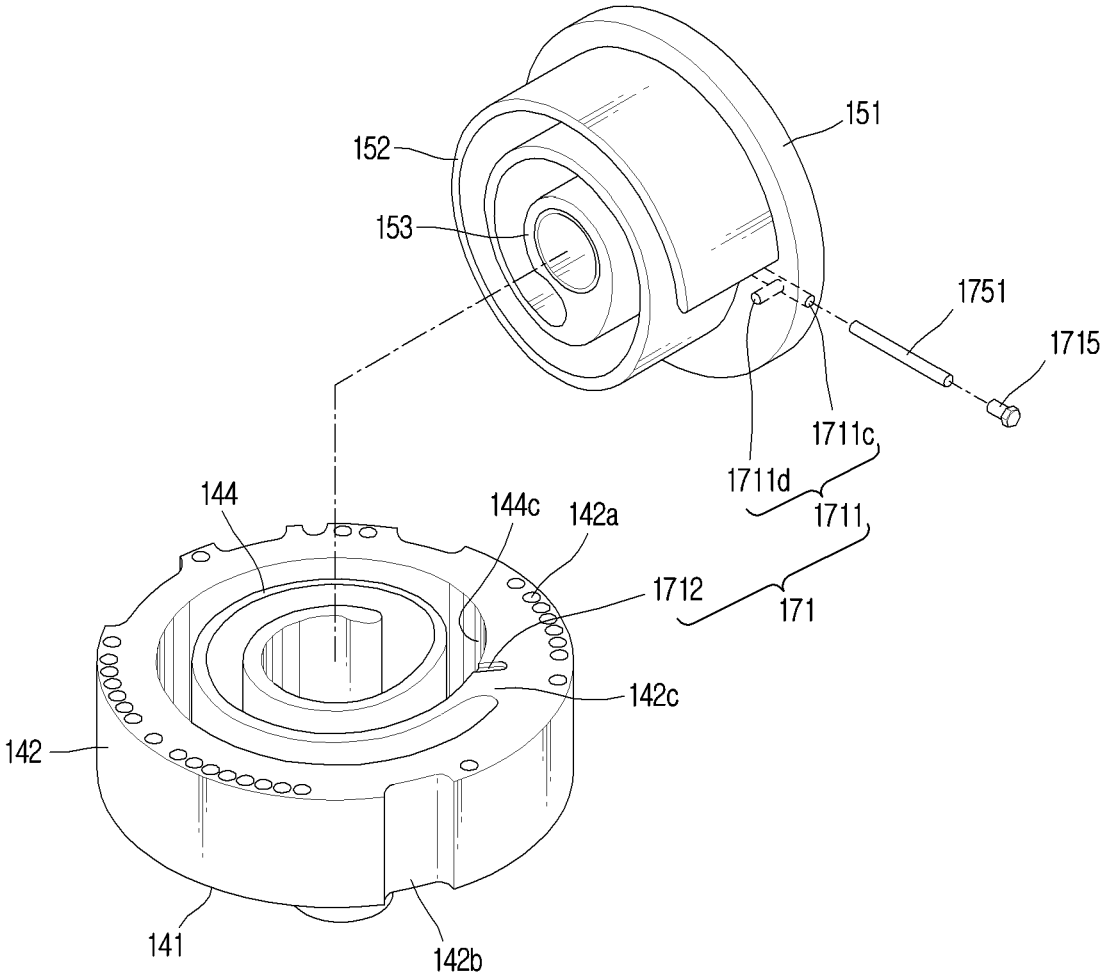
FIG. 8 is an exploded perspective view of a fixed scroll and an orbiting scroll in FIG. 5.
Figure 9:
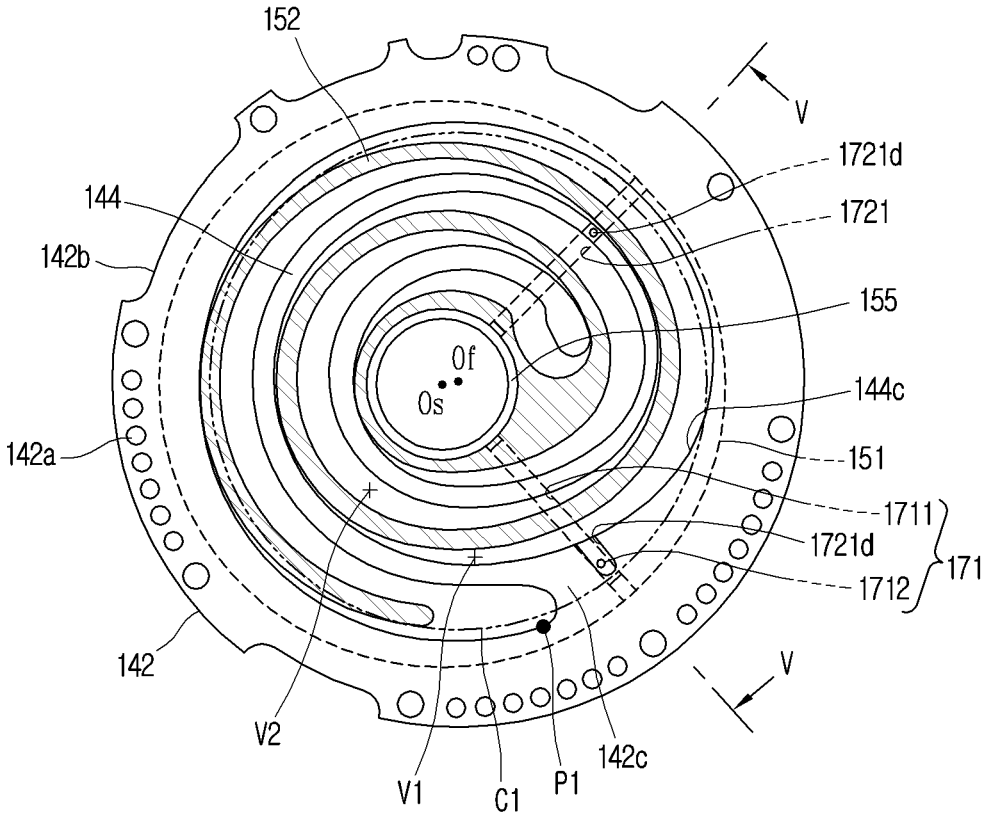
FIG. 9 is an assembled planar view of the fixed scroll and the orbiting scroll in FIG. 8.
Figure 10:
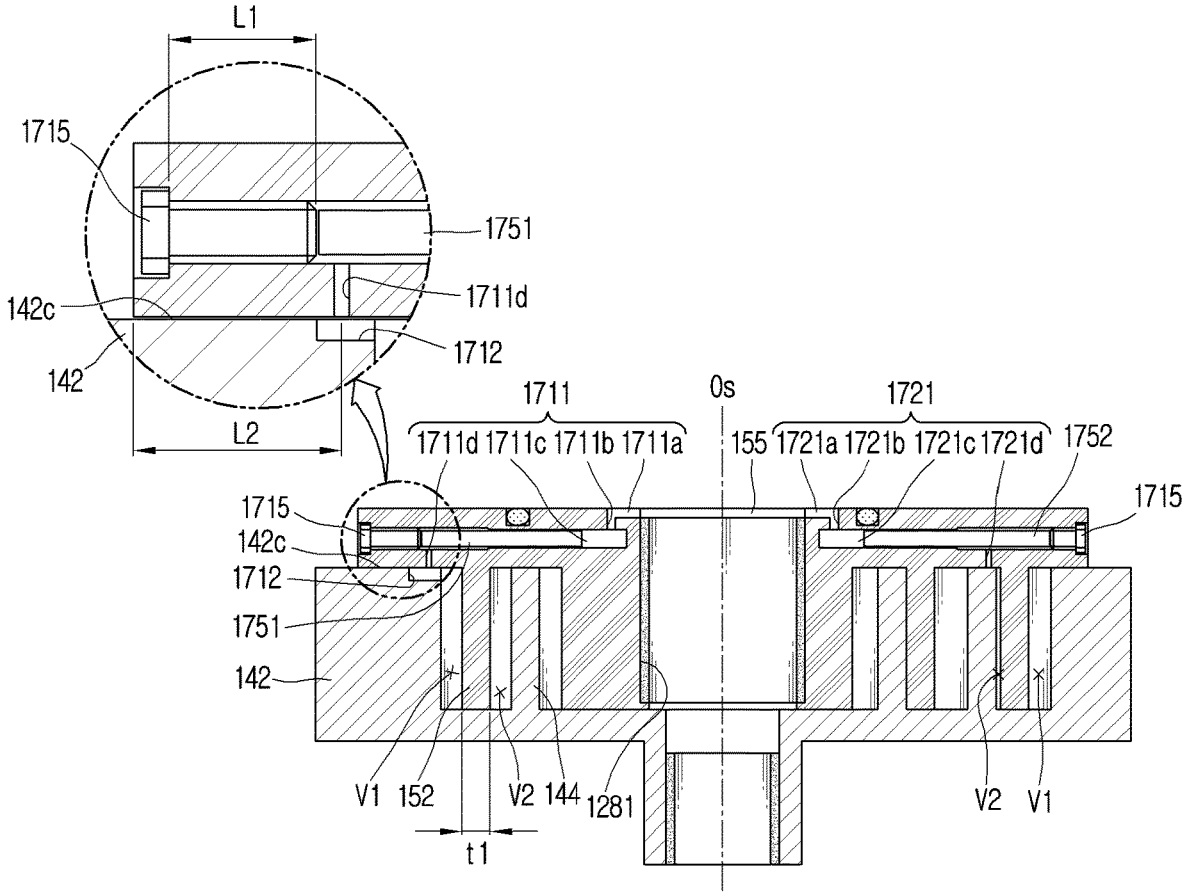
FIG. 10 is a sectional view taken along the line "V-V" in FIG. 9, which illustrates compression chamber oil supply holes of the orbiting scroll.
Figure 11:
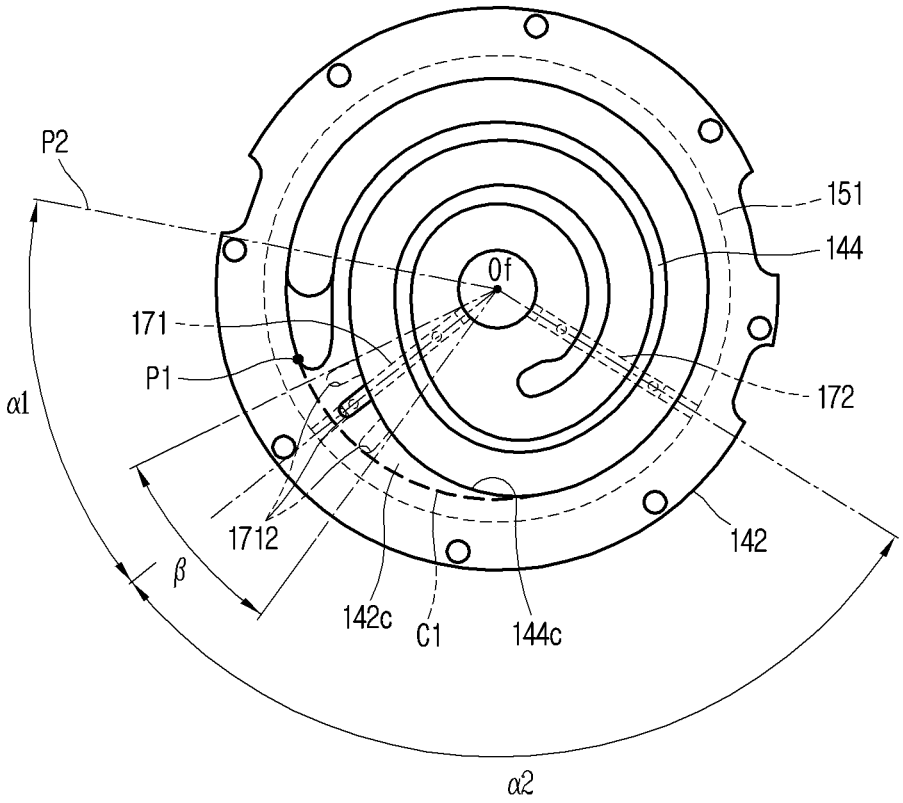
FIG. 11 is a planar view of a fixed scroll, which illustrates a position of an oil supply guide portion in accordance with an implementation of the present disclosure.

FIG. 8 is an exploded perspective view of the fixed scroll and the orbiting scroll in FIG. 5, FIG. 9 is an assembled planar view of the fixed scroll and the orbiting scroll in FIG. 8, FIG. 10 is a sectional view taken along the line "V-V" in FIG. 9, which illustrates a compression chamber oil supply hole of the orbiting scroll, and FIG. 11 is an enlarged planar view of a part "A" in FIG. 10.

As illustrated in FIGS. 8 to 11, the first oil supply passage 171 according to the implementation may be defined by the orbiting scroll 150 and the fixed scroll 140, and the second oil supply passage 172 may be formed through the orbiting scroll 150. Accordingly, the first oil supply passage 171 may be formed to be independent of the second oil supply passage 171, and an outlet of the first oil supply passage 171 may be located as close as possible to the center of the rotating shaft coupling portion 153.

For example, the first oil supply passage 171 may include a first oil supply hole 1711 and an oil supply guide portion 1712. The first oil supply hole 1711 may be formed between the rotating shaft coupling portion 153 of the orbiting scroll 150 and an axial side surface (i.e., a thrust surface) of the orbiting scroll 150 facing the fixed scroll 140. The oil supply guide portion 1712 may be formed in a thrust surface 142*c* of the fixed scroll 140 (precisely, the fixed side wall portion) to allow an outlet of the first oil supply hole 1711 to periodically communicate with the first compression chamber V1.

The first oil supply hole 1711 according to the implementation may include a first oil supply inlet portion 1711*a*, a first oil supply connection portion 1711*b*, a first oil supply penetration portion 1711*c*, and a first oil supply outlet portion 1711*d*. Accordingly, oil inside the oil accommodating portion 155 may be supplied to the first compression chamber V1 sequentially via the first oil supply inlet portion 1711*a*, the first oil supply connection portion 1711*b*, the first oil supply penetration portion 1711*c*, and the first oil supply outlet portion 1711*d*.

In detail, the first oil supply inlet portion 1711*a* may be recessed into the upper surface of the orbiting end plate 151 by a preset depth, so as to have a semicircular cross-section. Accordingly, oil contained in the oil accommodating portion 155 may move to the first oil supply inlet portion 1711*a* and spread to the upper surface of the orbiting scroll 150 at an inner space (e.g., back pressure chamber) of the back pressure sealing member 1515, thereby smoothly lubricating a gap between the main frame 130 and the orbiting scroll 150.

Considering the fact that a first pressure reducing member 1751 is disposed inside the first oil supply penetration portion 1711*c*, a length of the first oil supply inlet portion 1711*a* may preferably be as short as possible.

The first oil supply connection portion 1711*b* may extend in the axial direction from an end of the first oil supply inlet portion 1711*a* and be recessed by an intermediate depth of the orbiting end plate 151. Accordingly, oil flowing into the first oil supply inlet portion 1711*a* may move toward the first oil supply penetration portion 1711*c* through the first oil supply connection portion 1711*b*.

The first oil supply penetration portion 1711*c* may be formed through the inside of the orbiting end plate 151 in the radial direction from a lower end of the first oil supply connection portion 1711*b* to an outer circumferential surface of the orbiting end plate 151. Since the first oil supply penetration portion 1711*c* may be made in a direction from the outer circumferential surface to the inner circumferential surface of the orbiting end plate 151, a blocking bolt 1715 may be coupled to an outer end of the first oil supply penetration portion 1711*c*, so as to seal the outer end of the first oil supply penetration portion 1711*c*.

The first pressure reducing member 1751 may be inserted into the oil supply penetration portion 1711*c*. The first pressure reducing member 1751 may be configured as a pressure reducing pin having an outer diameter smaller than an inner diameter of the first oil supply penetration portion 1711*c*. Accordingly, oil in the oil accommodating portion 155 may be decompressed while passing through the first pressure reducing member 1751 inside the oil supply penetration portion 1561*c* and then supplied to the first compression chamber V1.

The first oil supply outlet portion 1711*d* may penetrate through the lower surface of the orbiting end plate 151 in a middle of the first oil supply penetration portion 1711*c* in the radial direction. The first oil supply outlet portion 1711*d* may have an inner diameter which is smaller than or equal to an inner diameter of the first oil supply penetration portion 1711*c*, for example, smaller than a wrap thickness of the fixed wrap 144.

The first oil supply outlet portion 1711*d* may be formed at a position spaced apart from an outer circumferential surface of the outermost orbiting wrap 152 by a preset interval. In other words, the first oil supply outlet portion 1711*d* may penetrate through a surface facing the fixed end plate 141, namely, the lower surface of the orbiting end plate 151, in the outer end of the first oil supply penetration portion 1711*c*.

As described above, as the blocking bolt 1715 is coupled to the outer end of the first oil supply penetration portion 1711*c*, the first oil supply outlet portion 1711*d* may penetrate through the lower surface of the orbiting end plate 151 in a middle position of the first oil supply penetration portion 1711*c*.

Referring to FIGS. 10 and 11, the first oil supply outlet portion 1711*d* according to the implementation may be formed close to the center of the orbiting end plate 151 by a preset interval from the outer circumferential surface of the orbiting end plate 151. For example, the first oil supply outlet portion 1711*d* may be located between the outer circumferential surface of the orbiting end plate 151 and an outer circumferential surface of an outermost wrap of the orbiting wrap 152 at a position where a spaced length L2 from the outer circumferential surface of the orbiting end plate 151 to the first oil supply outlet portion 1711*d* is greater than a wrap thickness t1 of the orbiting wrap 152. The spaced length L2 may be about 11 to 12 mm.

Accordingly, as the first oil supply outlet portion 1711*d* defining the outlet of the first oil supply hole 1711 is formed close to the center of the orbiting scroll 150, the overturning moment acting on the orbiting scroll 150 may be reduced, which may cause the behavior of the orbiting scroll 150 to be stable, thereby reducing leakage between the compression chambers and improving compression efficiency.

However, as the first oil supply outlet portion 1711*d* defining the outlet of the first oil supply hole 1711 may be formed at a position closer to the center Os of the orbiting scroll 150 at the outside of the outermost orbiting wrap 154, the first oil supply outlet portion 1711*d* may be located at a position facing the thrust surface 142*c* of the fixed scroll 140 during the orbiting motion. Then, the first oil supply outlet portion 1711*d* may be blocked by the thrust surface 142*c* of the fixed scroll 140 in a specific crank angle range, and as a result, the overturning moment acting on the orbiting scroll 150 may be increased due to pressure of oil moving toward the first compression chamber V1 through the first oil supply hole 1711.

Accordingly, in this implementation, the oil supply guide portion 1712 may be further formed in the thrust surface 142*c* of the fixed scroll 140. The oil supply guide portion 1712 may be recessed in the thrust surface 142*c*, such that its inner circumferential side can communicate with the first compression chamber V1. Accordingly, the first oil supply outlet portion 1711*d* defining the outlet of the first oil supply hole 1711 may communicate with the first compression chamber V1 through the oil supply guide portion 1712.

Figure 12:
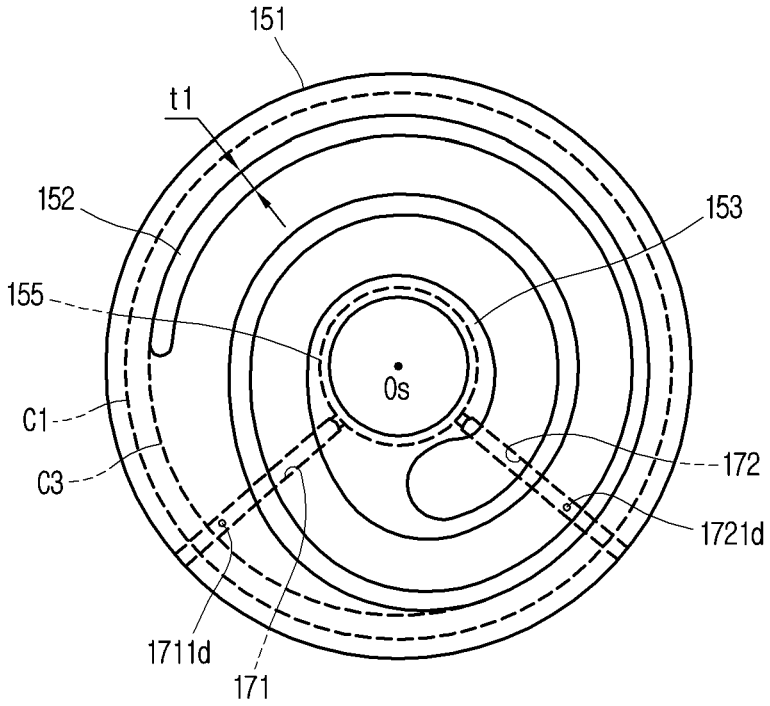
FIG. 12 is a planar view of an orbiting scroll, which illustrates positions of a first oil supply passage and a second oil supply passage in accordance with an implementation of the present disclosure.
Figure 13:
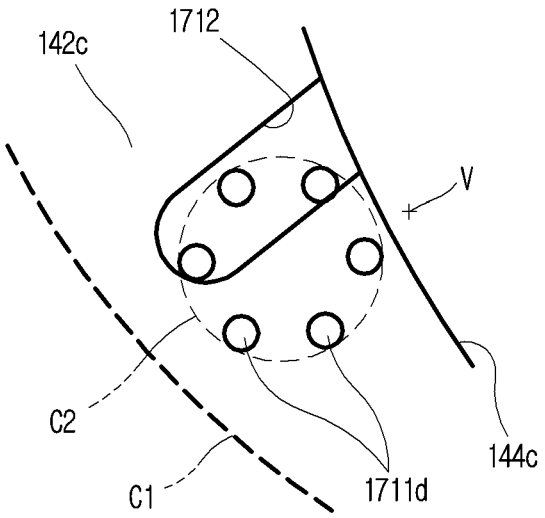
FIG. 13 is a schematic view illustrating a relationship between an oil supply hole and an oil supply guide portion in FIGS. 11 and 12.
Figure 14:
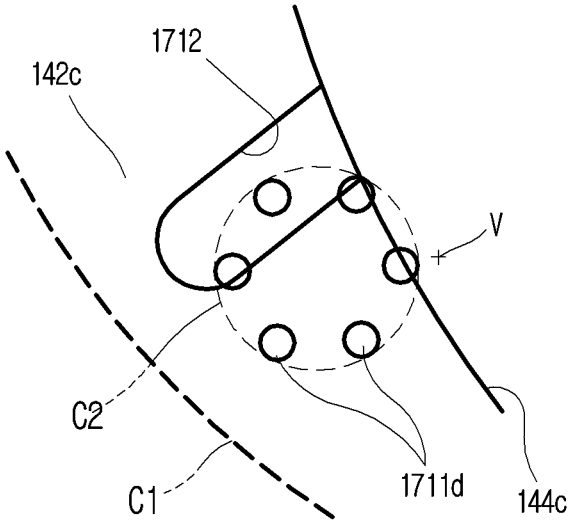
FIG. 14 is a schematic view illustrating another implementation of a relationship between the oil supply hole and the oil supply guide portion in FIG. 13.

FIG. 11 is a planar view of the fixed scroll, which illustrates the position of the oil supply guide portion in accordance with an implementation of the present disclosure, FIG. 12 is a planar view of the orbiting scroll, which illustrates the positions of the first oil supply passage and the second oil supply passage in accordance with an implementation of the present disclosure, FIG. 13 is a schematic view illustrating a relationship between the oil supply hole and the oil supply guide portion in FIGS. 11 and 12, and FIG. 14 is a schematic view illustrating another implementation of a relationship between the oil supply hole and the oil supply guide portion in FIG. 13.

As illustrated in FIGS. 11 to 14, the oil supply guide portion 1712 may be recessed into the upper surface of the fixed side wall portion 142, that is, the thrust surface 142*c* to an inner circumferential surface of an outermost wrap of the fixed wrap 144. Accordingly, the oil supply guide portion 1712 may allow the thrust surface 142*c* and the inner circumferential surface 144*c* of the outermost wrap of the fixed wrap 144 to communicate with each other, so that the first oil supply passage 171 can communicate with the first compression chamber V1.

The oil supply guide portion 1712 may have a cross-sectional area which is greater than or equal to that of the first oil supply outlet portion 1711*d* defining the outlet of the first oil supply hole 1711. Accordingly, the first oil supply outlet portion 1711*d* may periodically communicate with the oil supply guide portion 1712 at a crank angle of a predetermined section while performing an orbiting motion along the orbiting scroll 150.

For example, the oil supply guide portion 1712 may be formed in a rectangular shape which is long in the radial direction. Specifically, the oil supply guide portion 1712 may be formed to be longer in the radial direction than in a circumferential direction (or in a width direction). Accordingly, when the orbiting scroll 150 performs the orbiting motion, the oil supply guide portion 1712 may periodically (or intermittently) communicate with the first oil supply outlet portion 1711*d* defining the outlet of the first oil supply hole 1711.

This may result in minimizing or completely eliminating an overlap section Ao, in which the first oil supply section As1 where the first oil supply passage 171 communicates with the first compression chamber V1 and the second oil supply section As2 where the second oil supply passage 172 communicates with the second compression chamber V2 overlap each other. (See FIG. 16)

In addition, the oil supply guide portion 1712 may be located within a range of a first virtual circle C1 having a radius from the center of the fixed end plate 141 to the outermost end P1 of the fixed wrap 144. Accordingly, when the orbiting scroll 150 performs the orbiting motion, exposure of the oil supply guide portion 1712 to the outside of the orbiting end plate 151 or a shortage of a sealing distance to the oil supply guide portion 1712 can be prevented, thereby suppressing leakage of oil flowing along the first oil supply passage 171.

In addition, the first oil supply outlet portion 1711*d* defining the outlet of the first oil supply hole 1711 may be located within the range of the first virtual circle C1 during the orbiting motion of the orbiting scroll 150. Then, as described above, the overlap section Ao may be eliminated or a non-overlap section Ano may be more increased than the overlap section Ao, and also the first oil supply outlet portion 1711*d* may be formed closer to the center Os of the rotating shaft coupling portion 153 (or the center of the orbiting scroll or the center of the orbiting end plate).

In addition, the oil supply guide portion 1712 may be formed at a position in a crank angle range of approximately 300° to 340° in the rotating direction of the rotating shaft 125 from a suction completion angle P2 of the first compression chamber V1, for example, at a position where the crank angle is approximately 310° from the suction completion angle P2. Accordingly, a distance (interval) al from the suction completion angle P2 of the first compression chamber V1 to the oil supply guide portion 1712 may be about 20° to 60°, and a formation range β of the oil supply guide portion 1712 may be about 40°.

On the other hand, the second oil supply hole 1721, which will be described later, may be open by about 80° to 100° from the first oil supply hole 1711. In other words, a distance (interval) α2 between the first oil supply hole 1711 and the second oil supply hole 1721 may be about 90°, so as to be greater than the distance α1 from the suction completion angle P2 of the first compression chamber V1 to the oil supply guide portion 1712.

Accordingly, since the distance α2 between the first oil supply passage 171 and the second oil supply passage 172 is formed relatively wide, the increase in the overturning moment acting on the orbiting scroll 150 can be prevented even though high-pressure oil is sprayed through the first oil supply passage 171 and the second oil supply passage 172, thereby stabilizing the behavior of the orbiting scroll 150. As a result, leakage between the compression chambers can be suppressed, and compression efficiency can be improved.

On the other hand, the first oil supply outlet portion 1711*d* defining the outlet of the first oil supply hole 1711 may be located at the thrust surface 142*c* during the orbiting motion of the orbiting scroll 150 so as to periodically communicate with the oil supply guide portion 1712. For example, as illustrated in FIG. 13, the first oil supply outlet portion 1711*d* may be formed such that a second virtual circle C2 connecting an orbiting trajectory of the first oil supply outlet portion 1711*d* is formed outside the first compression chamber V1. This may result in eliminating the overlap section Ao in which the first and second oil supply sections As1 and As2 overlap each other or increasing the non-overlap section Ano to be longer than the overlap section Ao.

However, the first oil supply outlet portion 1711*d* may be formed to directly communicate with the first compression chamber V1 in a specific crank angle section during the orbiting motion of the orbiting scroll 150, and to be located outside the first compression chamber V1, namely, at the thrust surface 142*c* of the fixed scroll 140 at the other crank angles.

For example, as illustrated in FIG. 14, the first oil supply outlet portion 1711*d* may be formed such that a part of the second virtual circle C2 connecting the orbiting trajectory of the first oil supply hole 1711 overlaps the inside of the first compression chamber V1. Accordingly, the first oil supply outlet portion 1711*d* can be formed at a position closer to the center of the orbiting scroll 150, and the overturning moment acting on the orbiting scroll 150 can be reduced, thereby more stabilizing the behavior of the orbiting scroll 150, and more enhancing the compression efficiency.

In addition, by further increasing a coupling length L1 of the blocking bolt 1715, an assembly process for the blocking bolt 1715 can be facilitated, and reliability of the blocking bolt 1715 can be increased. In addition, as the orbiting trajectory of the first oil supply outlet portion 1711*d* passes through the inside of the first compression chamber V1, an amount of oil to be supplied to the first compression chamber V1 can be increased if necessary. Accordingly, the degree of freedom in designing a compression ratio for the compression chamber can be increased.

Referring to FIGS. 11 and 12, since the oil supply guide portion 1712 is located within the range of the first virtual circle C1, the first oil supply outlet portion 1711*d* provided in the orbiting scroll 150 may be located within a range of a third virtual circle C3.

In other words, the first oil supply outlet portion 1711*d* may be located between the outer circumferential surface of the orbiting end plate 151 and the outer circumferential surface of the outermost wrap of the orbiting end plate 152, and may also be located within a range of the third virtual circle C3 having a radius from the center Os of the orbiting end plate 151 to the outer circumferential surface of the outermost wrap of the orbiting wrap 152. Through this, a spaced length from the outer circumferential surface of the orbiting scroll 150 to the outlet of the first oil supply passage 171 may extend, thereby securing the coupling length for the blocking bolt 1715.

Referring back to FIGS. 9 and 10, the second oil supply passage 172 according to the implementation may be provided with a second oil supply hole 1721 formed through the orbiting end plate 151. The second oil supply hole 1721 may be formed to correspond to the first oil supply hole 1711 except for that it is spaced apart from the first oil supply hole 1711 by a preset crank angle to directly communicate with the second compression chamber V2.

For example, the second oil supply hole 1721 may include a second oil supply inlet portion 1721*a*, a second oil supply connection portion 1721*b*, a second oil supply penetration portion 1721*c*, and a second oil supply outlet portion 1721*d*. The second oil supply inlet portion 1721*a* may define an inlet of the second oil supply hole 1721, the second oil supply connection portion 1721*b* and the second oil supply penetration portion 1721*c* may define an intermediate passage of the second oil supply hole 1721, and the second oil supply outlet portion 1721*d* may define an outlet of the second oil supply hole 1721. Accordingly, oil inside the oil accommodating portion 155 may be supplied to the second compression chamber V2 sequentially via the second oil supply inlet portion 1721*a*, the second oil supply connection portion 1721*b*, the second oil supply penetration portion 1721*c*, and the second oil supply outlet portion 1721*d*.

In detail, the second oil supply hole 1721 may be formed almost similar to the first oil supply hole 1711. For example, the second oil supply inlet portion 1721*a* may correspond to the first oil supply inlet portion 1711*a*, the second oil supply connection portion 1721*b* may correspond to the first oil supply connection portion 1711*b*, the second oil supply penetration portion 1721*c* may correspond to the first oil supply penetration portion 1711*c*, and the second oil supply outlet portion 1721*d* may correspond to the first oil supply outlet portion 1711*d*. Accordingly, the second oil supply inlet portion 1721*a* may define an inlet of the second oil supply hole 1721, the second oil supply connection portion 1721*b* and the second oil supply penetration portion 1721*c* may define an intermediate passage of the second oil supply hole 1721, and the second oil supply outlet portion 1721*d* may define an outlet of the second oil supply hole 1721.

A second pressure reducing member 1752 may be inserted into the second oil supply penetration portion 1721*c*. The second pressure reducing member 1752 may be configured as a pressure reducing pin having an outer diameter smaller than an inner diameter of the second oil supply penetration portion 1721*c*. Accordingly, oil in the oil accommodating portion 155 may be decompressed while passing through the second pressure reducing member 1752 inside the second oil supply penetration portion 1562*c* and then supplied to the second compression chamber V2.

The second oil supply outlet portion 1721*d* may be formed at a position spaced apart from an inner circumferential surface of the outermost orbiting wrap 152 by a preset interval. For example, the second oil supply outlet portion 1721*d* may be formed at a position spaced apart from the inner circumferential surface of the outermost orbiting wrap 152 by an inner diameter of the second oil supply outlet portion 1721*d* or farther. Accordingly, the second oil supply outlet portion 1721*d* may be formed to be closer to the center Os of the orbiting scroll 150 than the first oil supply outlet portion 1711*d*.

In detail, the position of the first oil supply outlet portion 1721*d* will be described by comparing with the position of the second oil supply outlet portion 1711*d*. That is, a radial distance from the outer circumferential surface of the outermost orbiting wrap 152 to the first oil supply outlet portion 1711*d* may be longer than or equal to a radial distance from the inner circumferential surface of the outermost orbiting wrap 152 to the second oil supply outlet portion 1721*d*. Accordingly, when the orbiting scroll 150 performs the orbiting motion relative to the fixed scroll 140, the first oil supply hole 1711 (precisely, the first oil supply outlet portion) may almost communicate only with the first compression chamber V1 and the second oil supply hole 1562 (precisely, the second oil supply outlet portion) may almost communicate only with the second compression chamber V2.

Figure 15:
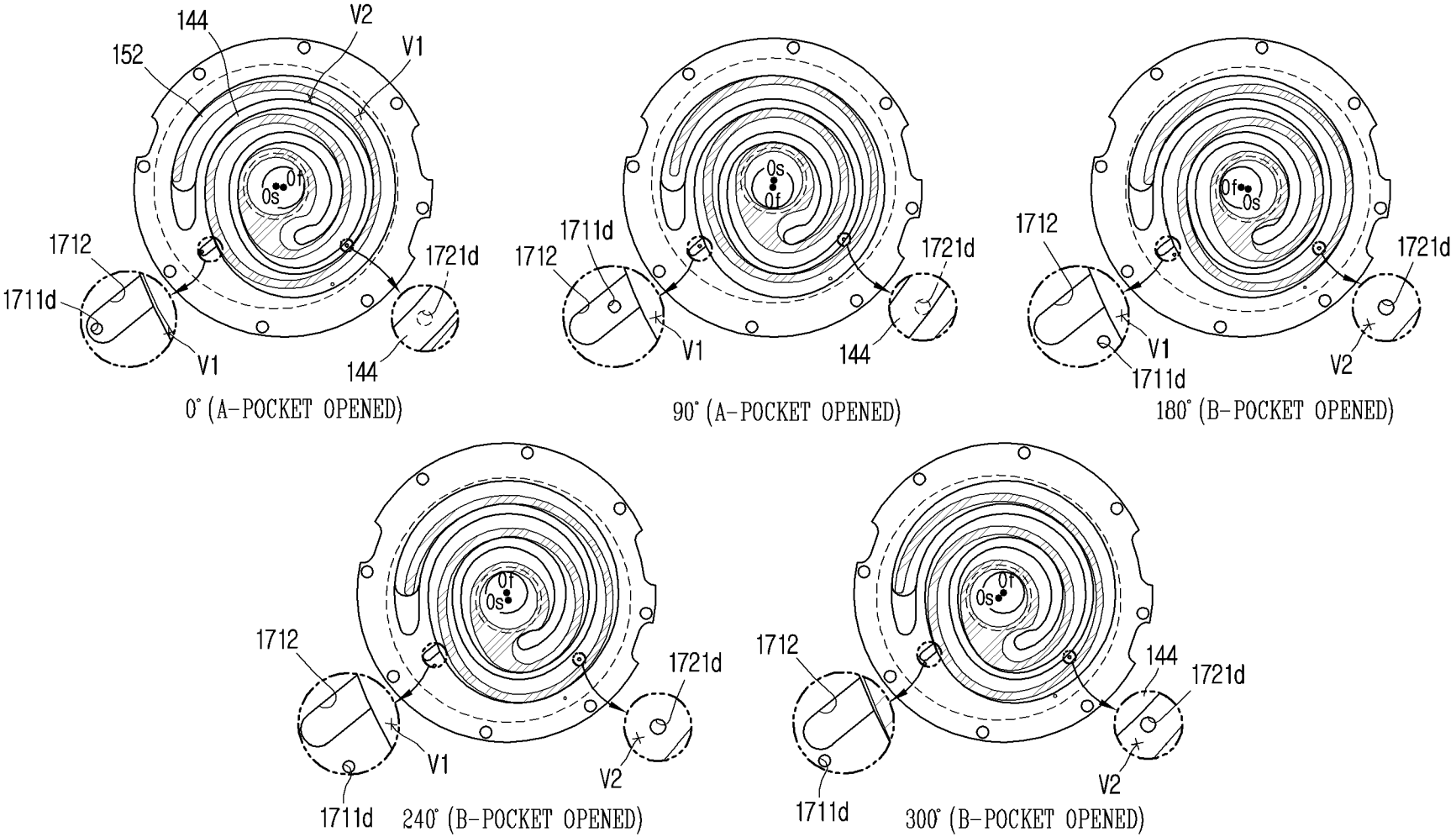
FIG. 15 is a schematic diagram illustrating a communication relationship between an outlet of a first oil supply hole and a first compression chamber and a communication relationship between an outlet of a second oil supply hole and a second compression chamber according to a crank angle.

FIG. 15 is a schematic diagram illustrating a communication relationship between an outlet of a first oil supply hole and a first compression chamber and a communication relationship between an outlet of a second oil supply hole and a second compression chamber according to a crank angle.

Referring to FIG. 15, when a crank angle is 0°, the first oil supply outlet portion 1711*d* defining the outlet of the first oil supply hole 1711 may overlap an upper end of the oil supply guide portion 1712. On the other hand, the second oil supply outlet portion 1721*d* defining the outlet of the second oil supply hole 1721 may be completely obscured by the fixed wrap 144. Accordingly, when the crank angle is 0°, the first oil supply hole 1711 may be opened to the first compression chamber V1 and the second oil supply hole 1721 may be closed to the second compression chamber V2.

Next, when the crank angle is 90°, the first oil supply outlet portion 1711*d* defining the outlet of the first oil supply hole 1711 may overlap the center of the oil supply guide portion 1712. On the other hand, the second oil supply outlet portion 1721*d* defining the outlet of the second oil supply hole 1721 may be obscured by the fixed wrap 144. Accordingly, when the crank angle is 90°, the first oil supply hole 1711 may be opened to the first compression chamber V1 and the second oil supply hole 1721 may be closed to the second compression chamber V2. This is similar to the case where the crank angle is 0°.

Next, when the crank angle is 180°, the first oil supply outlet portion 1711*d* defining the outlet of the first oil supply hole 1711 may be obscured by the thrust surface 142*c* of the fixed scroll 140 outside the oil supply guide portion 1712. On the other hand, the second oil supply outlet portion 1721*d* defining the outlet of the second oil supply hole 1721 may communicate with the second compression chamber V2 outside the fixed wrap 144. Accordingly, when the crank angle is 180°, the first oil supply hole 1711 may be closed with respect to the first compression chamber V1 and the second oil supply hole 1721 may be opened to the second compression chamber V2.

Next, when the crank angle is 240°, the first oil supply outlet portion 1711*d* defining the outlet of the first oil supply hole 1711 may be obscured by the thrust surface 142*c* of the fixed scroll 140 outside the oil supply guide portion 1712. On the other hand, the second oil supply outlet portion 1721*d* defining the outlet of the second oil supply hole 1721 may communicate with the second compression chamber V2 outside the fixed wrap 144. Accordingly, when the crank angle is 240°, the first oil supply hole 1711 may be closed with respect to the first compression chamber V1 and the second oil supply hole 1721 may be opened to the second compression chamber V2. This is similar to the case where the crank angle is 180°.

Next, when the crank angle is 300°, the first oil supply outlet portion 1711*d* defining the outlet of the first oil supply hole 1711 may be still obscured by the thrust surface 142*c* of the fixed scroll 140 outside the oil supply guide portion 1712. On the other hand, the second oil supply outlet portion 1721*d* defining the outlet of the second oil supply hole 1721 may still communicate with the second compression chamber V2 outside the fixed wrap 144. Accordingly, when the crank angle is 300°, the first oil supply hole 1711 may be still closed with respect to the first compression chamber V1 and the second oil supply hole 1721 may be still opened to the second compression chamber V2.

However, when the crank angle is 300°, the first oil supply outlet portion 1711*d* defining the outlet of the first oil supply hole 1711 may arrive near the oil supply guide portion 1712, so as to be in a state where the first oil supply hole 1711 and the first compression chamber V1 are just about to communicate with each other, and the second oil supply output portion 1721*d* defining the outlet of the second oil supply hole 1721 may be just before leaving the fixed wrap 144, so as to be in a state where the second oil supply hole 1721 and the second compression chamber V2 are just about to communicate with each other.

Accordingly, when the orbiting scroll 150 performs the orbiting motion relative to the fixed scroll 140, the first oil supply hole 1711 (precisely, the first oil supply outlet portion) may almost communicate only with the first compression chamber V1 and the second oil supply hole 1721 (precisely, the second oil supply outlet portion) may almost communicate only with the second compression chamber V2.

Figure 16:
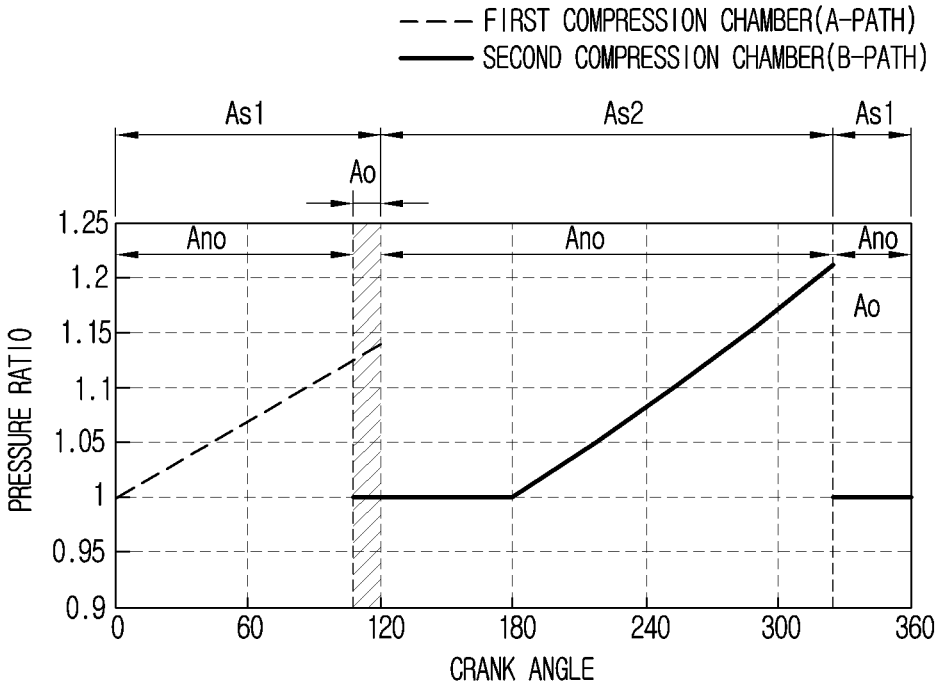
FIG. 16 is a graph showing analysis results of oil supply sections, based on a crank angle, in respective compression chambers to which a first oil supply passage and a second oil supply passage according to an implementation of the present disclosure are applied.

FIG. 16 is a graph showing analysis results of oil supply sections, based on a crank angle, in the respective compression chambers to which the first oil supply passage and the second oil supply passage according to the implementation of the present disclosure are applied.

Referring to FIG. 16, the oil supply section of the first compression chamber (A-PATH) V1 may correspond to a section in a crank angle range of approximately 0° to 120° and a section in a crank angle range of approximately 320° to 360°. That is, it can be seen that the non-oil supply section in the first compression chamber (A-PATH) V1, which is a section except for the oil supply section, may be a section in a crank angle range of approximately 120° to 320°.

However, this section in the crank angle range of 120° to 320° may be a section in which oil is supplied into the second compression chamber (B-PATH) V2. That is, it can be seen that the oil supply section of the second compression chamber (B-PATH) V2 is a section in a crank angle range of approximately 100° to 320°. That is, in the implementation, the first oil supply section As1 and the second oil supply section As2 may hardly overlap each other or may partially overlap each other only in the crank angle range of 100° to 120°.

Specifically, when it is defined that a section in which the first oil supply passage 171 communicates with the first compression chamber V1 is the first oil supply section As1, a section in which the second oil supply passage 172 communicates with the second compression chamber V2 is the second oil supply section As2, a section in which the first oil supply section As1 and the second oil supply section As2 overlap each other is the overlap section Ao, and a section Ano in which the first oil supply section As1 and the second oil supply section As2 do not overlap each other is a non-overlap section, the overlap section Ao may not be generated at all in the oil supply guide portion 1712 according to the implementation, or may be formed to be very short as compared with the non-overlap section Ano, even if generated.

This may allow oil to be smoothly supplied to the first compression chamber V1 and the second compression chamber V2, so as to reduce friction loss in the compression unit and prevent leakage between the compression chambers through the first oil supply hole 1711 and the second oil supply hole 1721. This may result in enhancing compression efficiency.

In addition, a non-oil supply section (no reference numeral) may be generated between the start of the first oil supply section As1 and the end of the second oil supply section As2 based on the crank angle. That is, the non-oil supply section, in which oil is not supplied because the first oil supply outlet portion 1711*d* and the second oil supply outlet portion 1721*d* are all blocked, may be generated between the start of the first oil supply section As1 and the end of the second oil supply section As2.

However, in the implementation, as illustrated in FIG. 16, the non-oil supply section may hardly be generated or may be so short to be negligible even if generated. In this way, the non-oil supply section in which oil is not supplied to the compression chambers V1 and V2 can be minimized so as to reduce friction loss as much as possible. The positions of the first oil supply outlet portion 1711*d* and the second oil supply outlet portion 1721*d* have been illustrated as positions where the average pressure ratio of each of the first compression chamber V1 and the second compression chamber V2 is 1.1.

Hereinafter, a description will be given of another implementation of an oil supply guide portion.

That is, the oil supply guide portion may be configured as a single guide portion formed in the radial direction when projected in the axial direction, but in some cases, an oil supply guide groove may be configured as a plurality of guide portions.

Figure 17:
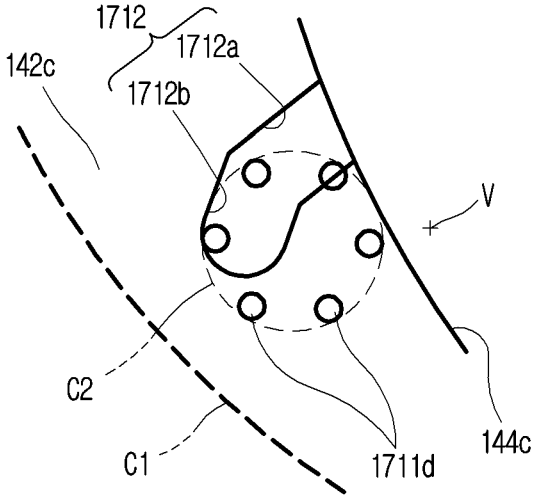
FIGS. 17 and 18 are schematic views illustrating another implementation of an oil supply guide portion, and a relationship with a first oil supply hole.
Figure 18:
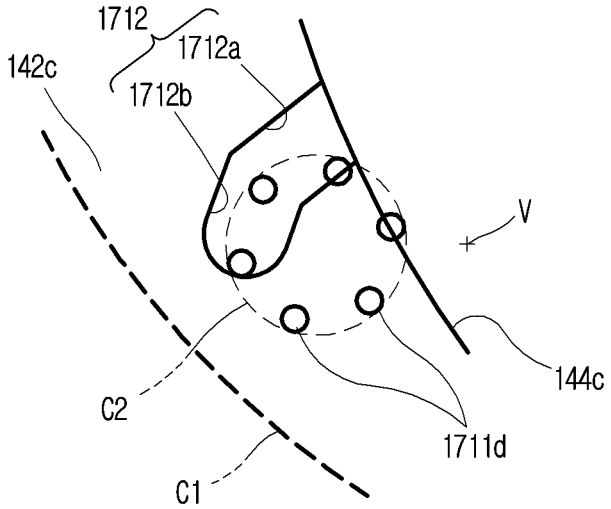

FIGS. 17 and 18 are schematic views illustrating another implementation of an oil supply guide portion and a relationship with a first oil supply hole.

Referring to FIG. 17, the oil supply guide portion 1712 according to the another implementation may include a plurality of guide portions 1712*a* and 1712*b* provided to communicate with the thrust surface 142*c* of the fixed scroll 140. For example, the oil supply guide portion 1712 may include a first guide portion 1712*a* extending in the radial direction and a second guide portion 1712*b* extending in a direction intersecting with the radial direction so as to be inclined with respect to the first guide portion 1712*a*.

Specifically, the first guide portion 1712*a* may extend in the radial direction from the inner circumferential surface 144*c* of the outermost fixed wrap to the thrust surface 142*c*, and the second guide portion 1712*b* may be formed to be inclined with respect to an outer end of the first guide portion 1712*a*. The second guide portion 1712*b* may be inclined in a direction opposite to the rotating direction of the rotating shaft.

Meanwhile, the second oil supply passage 172 may be formed through the orbiting scroll 150 as in the foregoing implementations. Since this is the same as the foregoing implementations, a detailed description thereof will be omitted.

Even when the oil supply guide portion 1712 is formed to be inclined as described above, the shape or position of the first oil supply hole 1711 may be formed in the same manner as in the foregoing implementation. For example, the first oil supply hole 1711 may be formed such that a second virtual circle C2 connecting an orbiting trajectory of the first oil supply outlet portion 1711*d* defining its outlet is located outside the first compression chamber V1 as illustrated in FIG. 17, or may be formed such that a part of the second virtual circle C2 overlaps the inside of the first compression chamber V1 as illustrated in FIG. 18.

The operation effects thereof are the same as or similar to those of the foregoing implementation, and thus a detailed description thereof will be omitted. However, since the oil supply guide groove 1712*a* according to the implementation is formed such that the first guide portion 1712*a* and the second guide portion 1712*b* extend in a bent manner, the overlap section between the first oil supply section As1 and the second oil supply section As2 may further be reduced.

For example, as illustrated in FIGS. 17 and 18, the second guide portion 1712*b* may be bent in a reverse-rotating direction of the rotating shaft 125 at the end of the first guide portion 1712*a*, so as to correspond to the circumference of the second virtual circle C2 connecting the orbiting trajectory of the first oil supply outlet portion 1711*d*.

Then, the section in which the oil supply guide portion 1712 and the first oil supply outlet portion 1711*d* communicate with each other may be longer than that in the case where the oil supply guide portion 1712 is straightly formed as shown in the foregoing implementation. Since the first oil supply section As1 in which the first compression chamber V1 and the first oil supply outlet portion 1711*d* communicate with each other increases, the crank angle of the first oil supply section As1 or the second oil supply section As2 may be appropriately adjusted as needed.

In addition, when the second guide portion 1712*b* is bent in the reverse-rotating direction of the rotating shaft 125 at the end of the first guide portion 1712*a* as illustrated in this implementation, the position of the second oil supply outlet portion 1721*d* may be further moved toward a section side end of the orbiting wrap 152, as compared to the case where the oil supply guide portion 1712 is straightly formed as illustrated in the foregoing implementation.

Accordingly, the crank angle between the first oil supply passage (precisely, the oil supply guide portion) 171 and the second oil passage (precisely, the second oil supply hole) 172 may increase and the overturning moment acting on the orbiting scroll 150 can be more reduced. In addition, the spaced length L2 from the outer circumferential surface of the orbiting end plate 151 to the first oil supply outlet portion 1711*d* may become longer, so as to more facilitate the coupling of the blocking bolt 1715.

Hereinafter, a description will be given of another implementation of an oil supply guide portion.

That is, in the foregoing implementation, the oil supply guide portion is configured as a single groove to directly communicate with the first compression chamber on the thrust surface of the fixed scroll. However, in some cases, an oil supply guide portion may also be configured as a combination of a groove and a hole so as to communicate with the first compression chamber through the thrust surface of the fixed scroll.

Figure 19:
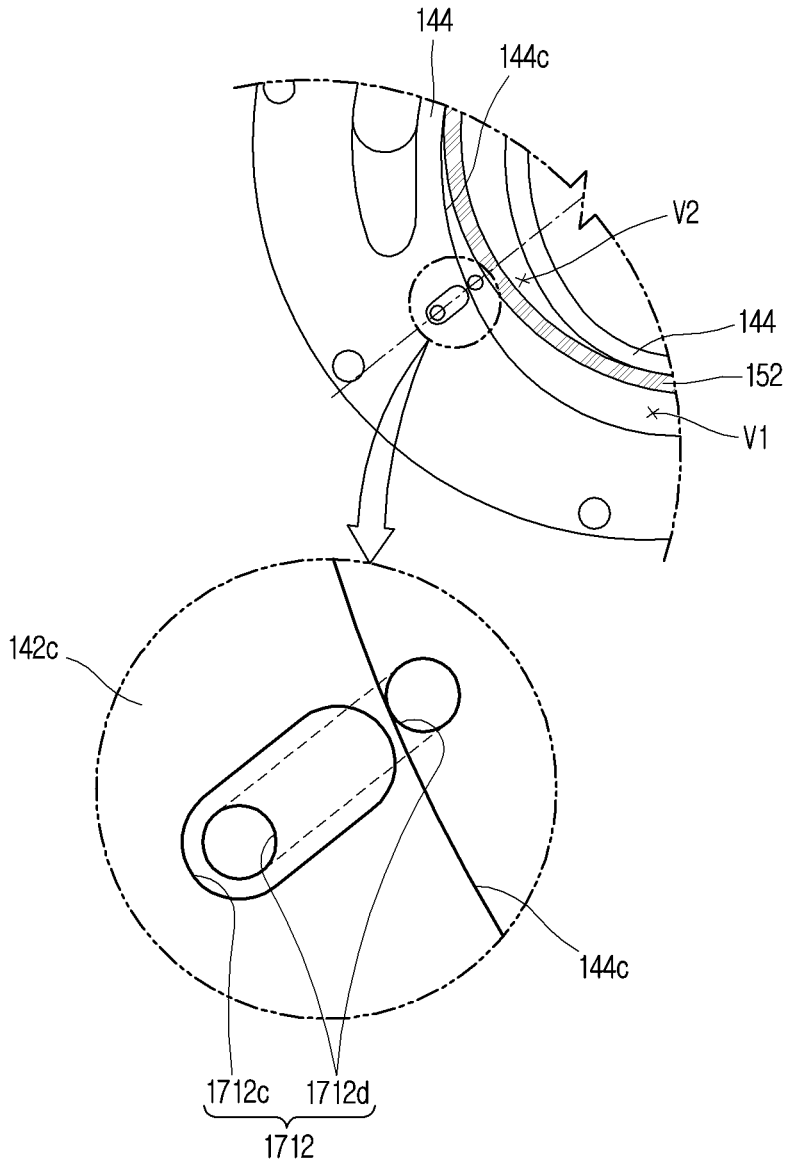
FIGS. 19 and 20 are a planar view and a sectional view illustrating another implementation of an oil supply guide portion.
Figure 20:
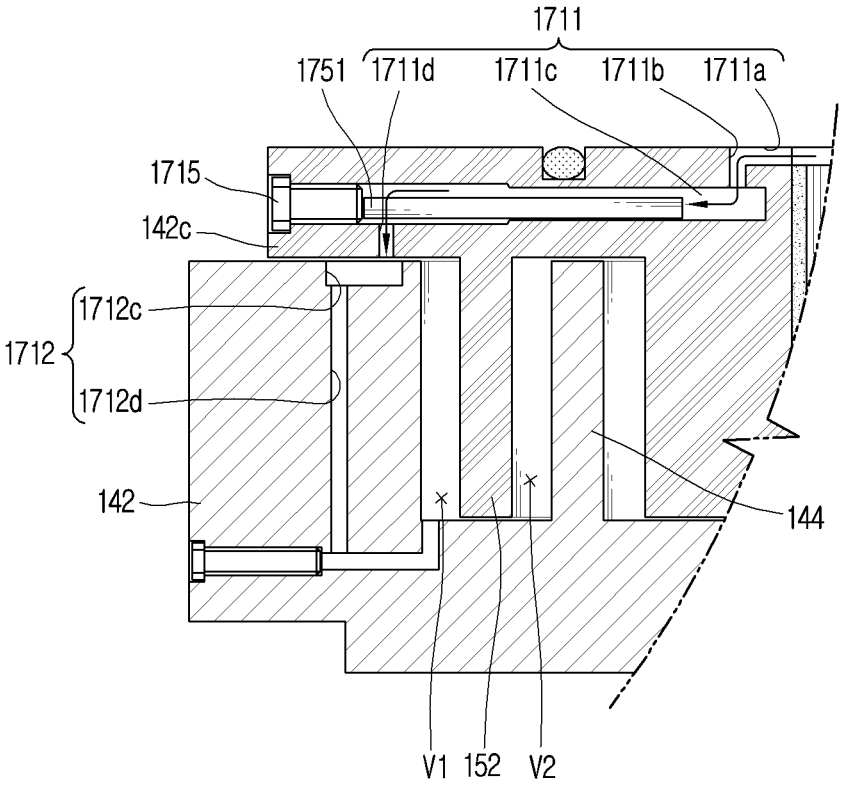

FIGS. 19 and 20 are a planar view and a sectional view illustrating another implementation of an oil supply guide portion.

As illustrated in FIGS. 19 and 20, the oil supply guide portion 1712 according to this implementation may include an oil supply guide groove 1712*c* recessed in the thrust surface 142*c* of the fixed scroll 140, and an oil supply guide hole 1712*d* connecting the oil supply guide groove 1712*c* and the first compression chamber V1.

For example, the oil supply guide groove 1712*c* may be formed in the thrust surface 142*c* of the fixed scroll 140, as in the foregoing implementation, in a manner that its inner end is spaced apart from the inner circumferential surface 144*c* of the outermost fixed wrap 144. Accordingly, the oil supply guide groove 1712*c* may be separated from the first compression chamber V1 located at the outermost side, formed by the inner circumferential surface 144*c* of the outermost fixed wrap 144.

The oil supply guide hole 1712*d* may be formed through the fixed side wall portion 142 and the fixed end plate 141 inside the oil supply guide groove 1712*c*, and then penetrate through the bottom surface of the first compression chamber located at the outermost side. Accordingly, the oil supply guide hole 1712*d* may have a cross-section in a shape like 'U' when projected from the front. Although not shown in the drawings, an outlet of the oil supply guide hole 1712*d* may alternatively be formed on the inner circumferential surface 144*c* of the outermost fixed wrap 144. In this case, the oil supply guide hole 1712*d* may be formed in a shape like '∟'.

An outlet area of the oil supply guide hole 1712*d* may be smaller than a wrap thickness t1 of the orbiting wrap 152 so as to be as close as possible to the inner circumferential surface 144*c* of the outermost fixed wrap 144 forming the first compression chamber V1. In some cases, the outlet of the oil supply guide hole 1712*d* may alternatively be connected to the inner circumferential surface 144*c* of the outermost fixed wrap 144.

The oil supply guide hole 1712*d* may be formed in the radial direction when projected in the axial direction. For example, a virtual line connecting both ends of the oil supply guide hole 1712*d* may be formed in the radial direction, which is the same direction in which the oil supply guide groove 1712*c* extends.

However, in some cases, the oil supply guide hole 1712*d* may alternatively be formed to intersect with an extending direction of the oil supply guide groove 1712*c*. For example, the outlet of the oil supply guide hole 1712*d* communicating with the first compression chamber V1 may be formed at a discharge side or a suction side with respect to the extending direction of the oil supply guide groove 1712*c*. This may be set in consideration of a position at which the second oil supply passage 172 communicates with the second compression chamber V2.

Meanwhile, the second oil supply passage 172 may be formed through the orbiting scroll 150 as in the foregoing implementations. Since this is the same as the foregoing implementations, a detailed description thereof will be omitted.

Even when the oil supply guide portion 1712 is provided with the oil supply guide groove 1712*c* and the oil supply guide hole 1712*d*, the basic configuration of the first oil supply passage 171 and thusly-obtained operation effects are the same as those in the foregoing implementations.

However, in this implementation, since the oil supply guide portion 1712 forming the part of the first oil supply passage 171 includes the oil supply guide hole 1712*d*, the volume of the oil supply guide portion 1712 may increase while maintaining the outlet area of the oil supply guide portion 1712. Accordingly, a constant amount of oil can be stored in the oil supply guide portion (oil supply guide hole) 1712, so as to be supplied into the first compression chamber V1 as soon as restarting the stopped compressor, thereby suppressing friction loss to be caused upon the restart.

Hereinafter, a description will be given of another implementation of an oil supply passage.

That is, in the foregoing implementation, the first oil supply passage is formed to communicate with the orbiting scroll and the fixed scroll, but in some cases, the first oil supply passage may be formed through the main frame and the fixed scroll.

Figure 21:
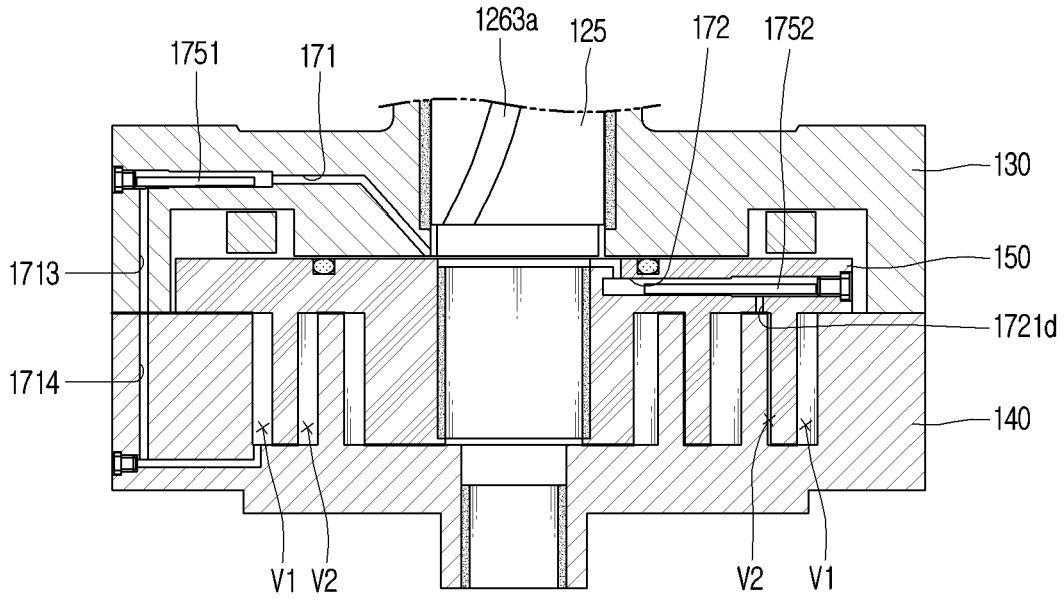
FIG. 21 is a sectional view illustrating another implementation of an oil supply guide portion.

FIG. 21 is a sectional view illustrating another implementation of an oil supply guide portion.

Referring to FIG. 21, the first oil supply passage 171 according to this implementation may include a frame oil supply hole 1713 formed through the main frame 130, and a scroll oil supply hole 1714 formed through the fixed scroll 140 to communicate with the frame oil supply hole 1713.

The frame oil supply hole 1713 may have one end communicating with a back pressure chamber (no reference numeral) defining an inner space of the back pressure sealing member 1515, and another end formed through the lower surface of the frame side wall portion 132 through the frame end plate 131.

The scroll oil supply hole 1714 may have one end formed through the upper surface of the fixed side wall portion 142 of the fixed scroll 140 to communicate with the another end of the frame oil supply hole 1713, and another end formed through the bottom surface of the fixed end plate 141 forming the first compression chamber V1 through the fixed side wall portion 142.

The another end of the scroll oil supply hole 1714 defining the outlet of the first oil supply passage 171 may be formed at the same position as in the implementation of FIG. 19, and in some cases, may alternatively be formed at a different position, that is, a position in consideration of whether or not it overlaps the second oil supply passage 172.

A first pressure reducing member 1751 may be disposed in the middle of the first oil supply passage 171, as in the foregoing implementations. For example, the first pressure reducing member 1751 may be inserted into the frame oil supply hole 1713 or the scroll oil supply hole 1714.

Meanwhile, the second oil supply passage 172 may be formed through the orbiting scroll 150 as in the foregoing implementations. Since this is the same as the foregoing implementations, a detailed description thereof will be omitted.

As described above, even when the first oil supply passage 171 is formed sequentially through the main frame 130 and the fixed scroll 140, the position and the inner diameter of the outlet of the first oil supply passage 171 may be the same or almost similar to those in the foregoing implementation. Accordingly, the basic configuration and operation effects are almost similar to those in the foregoing implementations.

However, in this implementation, as the first oil supply passage 171 is formed in the main frame 130 and the fixed scroll 140 which are fixed, it may not be necessary to consider the stability of the behavior of the orbiting scroll 150 due to the first oil supply passage. Therefore, the degree of freedom in designing the position of the first oil supply passage 171 can be improved. This may facilitate the formation of the first oil supply passage 171.

Although not shown in the drawings, the second oil supply passage 172 as well as the first oil supply passage 171 may also be formed through the main frame 130 and the fixed scroll 140. Even in this case, the outlet of the first oil supply passage 171 and the outlet of the second oil supply passage 172 may be located at the same positions as those in the foregoing implementations. However, in some cases, the second oil supply passage may be formed at a position different from that in the foregoing implementations, in consideration of whether or not the outlet of the first oil supply passage 171 and the outlet of the second oil supply passage 172 overlap each other.

On the other hand, the foregoing implementations have illustrated the oil supply structure in the scroll compressor having the suction check valve in the suction passage. However, in some cases, the oil supply structure may also be equally applied to a scroll compressor without a suction check valve in a suction passage.

Figure 22:
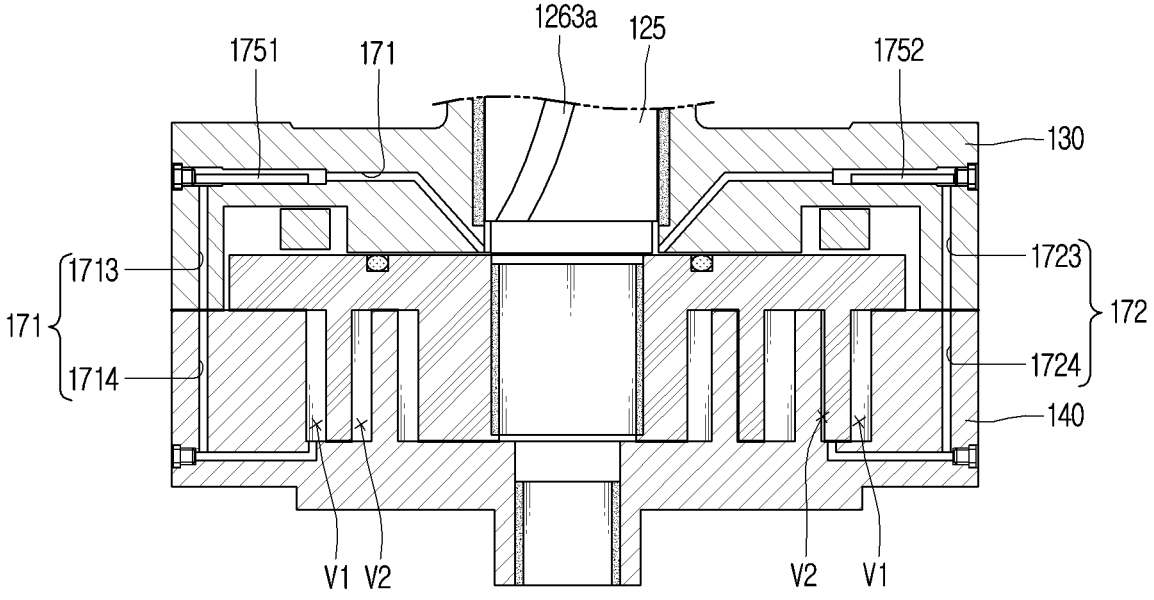
FIG. 22 is a longitudinal sectional view illustrating another implementation of a scroll compressor, to which an oil supply passage according to an implementation of the present disclosure is applied.

FIG. 22 is a longitudinal sectional view illustrating another implementation of a scroll compressor, to which an oil supply passage according to an implementation of the present disclosure is applied.

Referring to FIG. 22, a basic structure of a scroll compressor according to this implementation is the same as those of the foregoing implementations illustrated in FIGS.

2 and 21, and thus a description thereof will be replaced with the description of the foregoing implementations.

For example, in the scroll compressor according to this implementation, the first oil supply passage 171 and the second oil supply passage 172 may be provided to communicate with the first compression chamber V1 and the second compression chamber V2, respectively.

The first oil supply passage 171 may be formed in the same manner as in the implementation of FIG. 21. In addition, the second oil supply passage 172 may be formed through the main frame 130 and the fixed scroll 140, unlike the implementation of FIG. 21. In other words, in this implementation, each of the first oil supply passage 171 and the second oil supply passage 172 may include the frame oil supply hole 1713, 1723 provided in the main frame 130, and the scroll oil supply hole 1714, 1723 provided in the fixed scroll 140.

Even in this case, the first oil supply section As1 and the second oil supply section As2 may not overlap each other, or the overlap section Ao may be formed to be significantly shorter than the non-overlap section Ano, as shown in FIG. 16. The positions of the first oil supply outlet portion 1711*d* and the second oil supply outlet portion 1721*d* are the same as those of the foregoing implementation.

Accordingly, the first compression chamber V1 and the second compression chamber V2 can be prevented from communicating with each other through the first oil supply passage 171 and the second oil supply passage 172, thereby suppressing refrigerant from leaking between the compression chambers in advance.

However, in this implementation, the refrigerant suction pipe 115 may be inserted sequentially through the casing 110 and the fixed scroll 140 in the radial direction so as to communicate with the suction chamber Vs. In this case, a separate suction check valve may not be installed between the refrigerant suction pipe 115 and the suction chamber, or in some cases, a suction check valve (not shown) may alternatively be installed.

Meanwhile, although not shown in the drawings, the first oil supply passage 171 and the second oil supply passage 172 may be equally applied to a so-called top-compression type scroll compressor in which a compression unit is located above a motor unit. A description of this will be replaced by the description of the foregoing implementations.

What is claimed is:

1. A scroll compressor comprising:

a casing;

a main frame disposed in an inner space of the casing;

a fixed scroll coupled to the main frame, the fixed scroll comprising a fixed end plate and a fixed wrap that is disposed at a surface of the fixed end plate;

an orbiting scroll that is disposed between the main frame and the fixed scroll and in contact with a thrust surface of the fixed scroll, the orbiting scroll comprising (i) an orbiting end plate facing the fixed end plate and (ii) an orbiting wrap that is engaged with the fixed wrap to thereby define a first compression chamber and a second compression chamber, wherein the first compression chamber is defined between an inner circumferential surface of the fixed wrap and an outer circumferential surface of the orbiting wrap, and the second compression chamber is defined between an outer circumferential surface of the fixed wrap and an inner circumferential surface of the orbiting wrap;

a first oil supply passage that is in fluid communication with the first compression chamber, the first oil supply passage comprising an oil supply guide portion defined at the thrust surface of the fixed scroll; and a second oil supply passage that is spaced apart from the first oil supply passage and in fluid communication with the second compression chamber, wherein the first compression chamber is configured to extend to a suction completion position based on the orbiting scroll moving relative to the fixed scroll, and wherein an angle defined between the first oil supply passage and the second oil supply passage is greater than an angle defined between the suction completion position and the oil supply guide portion.

2. The scroll compressor of claim 1, wherein the oil supply guide portion is disposed within a first virtual circle having a radius connecting a center of the fixed end plate to an outermost end of the fixed wrap.

3. The scroll compressor of claim 1, wherein the oil supply guide portion is recessed from the thrust surface of the fixed scroll and extends toward the inner circumferential surface of the fixed wrap, and wherein an inner circumferential side of the oil supply guide portion is in fluid communication with the first compression chamber.

4. The scroll compressor of claim 1, wherein the oil supply guide portion comprises:

an oil supply guide groove that is recessed from the thrust surface of the fixed scroll; and an oil supply guide hole that is defined inside the oil supply guide groove and passes through the fixed scroll, the oil supply guide hole being in fluid communication with the first compression chamber.

5. The scroll compressor of claim 1, wherein the first oil supply passage further comprises a first oil supply hole that is defined in the orbiting scroll, the first oil supply hole being configured to fluidly communicate with the oil supply guide portion based on an orbiting motion of the orbiting scroll along an orbiting trajectory relative to the fixed scroll, and wherein an end of the first oil supply hole is configured to, during the orbiting motion of the orbiting scroll, face the oil supply guide portion and be located within a first virtual circle having a radius connecting a center of the fixed end plate to an outermost end of the fixed wrap.

6. The scroll compressor of claim 1, wherein a radial length of the oil supply guide portion is greater than a circumferential length of the oil supply guide portion.

7. The scroll compressor of claim 1, wherein the oil supply guide portion comprises:

a first guide portion that extends in a radial direction along the thrust surface of the fixed end plate; and a second guide portion that extends from the first guide portion in a direction intersecting the radial direction.

8. The scroll compressor of claim 1, wherein the first oil supply passage further comprises a first oil supply hole defined at the orbiting scroll, the first oil supply hole being configured to fluidly communicate with the oil supply guide portion based on the orbiting scroll moving relative to the fixed scroll, wherein an end of the first oil supply hole is configured face the oil supply guide portion and move along an orbiting trajectory based on the orbiting scroll moving relative to the fixed scroll, and wherein the orbiting trajectory of the first oil supply hole is disposed within a virtual circle outside the first compression chamber.

9. The scroll compressor of claim 1, wherein the first oil supply passage further comprises a first oil supply hole defined at the orbiting scroll, the first oil supply hole being configured to fluidly communicate with the oil supply guide portion based on the orbiting scroll moving relative to the fixed scroll, wherein an end of the first oil supply hole is configured to move along an orbiting trajectory based on the orbiting scroll moving relative to the fixed scroll, and wherein the orbiting trajectory of the first oil supply hole is disposed within a virtual circle that overlaps with an inside of the first compression chamber.

10. The scroll compressor of claim 1, wherein an end of the first oil supply passage is located between an outer circumferential surface of the orbiting end plate and an outermost circumferential surface of the orbiting wrap, and wherein the end of the first oil supply passage is located within a virtual circle having a radius connecting a center of the orbiting end plate to the outermost circumferential surface of the orbiting wrap.

11. The scroll compressor of claim 10, wherein the first oil supply passage further comprises:

a connecting portion that extends through the orbiting end plate in a radial direction; and an outlet portion that is defined through a surface of the orbiting end plate facing the fixed end plate, the outlet portion being connected to the connecting portion, and wherein a distance from the outer circumferential surface of the orbiting end plate to the outlet portion is greater than a wrap thickness of the orbiting wrap.

12. The scroll compressor of claim 1, wherein the orbiting wrap and the fixed wrap are configured to define a pressure profile in each of the first compression chamber and the second compression chamber based on a crank angle of the orbiting scroll relative to the fixed scroll, the pressure profile comprising:

a first oil supply section defined based on the first oil supply passage fluidly communicating with the first compression chamber, and a second oil supply section defined based on the second oil supply passage fluidly communicating with the second oil supply passage, an overlap section in which the first oil supply section and the second oil supply section overlap with each other, and a non-overlap section in which the first oil supply section and the second oil supply section do not overlap with each other, and wherein a range of the crank angle corresponding to the overlap section is less than a range of the crank angle corresponding to the non-overlap section.

13. A scroll compressor comprising:

a casing;

a main frame disposed in an inner space of the casing;

a fixed scroll coupled to the main frame, the fixed scroll comprising a fixed end plate and a fixed wrap that is disposed at a surface of the fixed end plate;

an orbiting scroll disposed between the main frame and the fixed scroll, the orbiting scroll comprising (i) an orbiting end plate facing the fixed end plate and (ii) an orbiting wrap engaged with the fixed wrap to thereby define a first compression chamber and a second compression chamber, wherein the first compression chamber is defined between an inner circumferential surface of the fixed wrap and an outer circumferential surface of the orbiting wrap, and the second compression chamber is defined between an outer circumferential surface of the fixed wrap and an inner circumferential surface of the orbiting wrap;

a first oil supply passage that is in fluid communication with the first compression chamber; and a second oil supply passage that is spaced apart from the first oil supply passage and in fluid communication with the second compression chamber, wherein at least one of the first oil supply passage or the second oil supply passage passes through the main frame and the fixed scroll, wherein the orbiting wrap and the fixed wrap are configured to define a pressure profile in each of the first compression chamber and the second compression chamber based on a crank angle of the orbiting scroll relative to the fixed scroll, the pressure profile comprising:

a first oil supply section defined based on the first oil supply passage fluidly communicating with the first compression chamber, and a second oil supply section defined based on the second oil supply passage fluidly communicating with the second oil supply passage, an overlap section in which the first oil supply section and the second oil supply section overlap with each other, and a non-overlap section in which the first oil supply section and the second oil supply section do not overlap with each other, and wherein a range of the crank angle corresponding to the overlap section is less than a range of the crank angle corresponding to the non-overlap section.

14. The scroll compressor of claim 13, wherein the first oil supply passage is configured to fluidly communicate with the first compression chamber while the second oil supply passage is blocked from the second compression chamber.

15. A scroll compressor comprising:

a casing;

a main frame disposed in an inner space of the casing;

a fixed scroll coupled to the main frame, the fixed scroll comprising a fixed end plate and a fixed wrap that is disposed at a surface of the fixed end plate;

an orbiting scroll disposed between the main frame and the fixed scroll, the orbiting scroll comprising (i) an orbiting end plate facing the fixed end plate and (ii) an orbiting wrap engaged with the fixed wrap to thereby define a first compression chamber and a second compression chamber, wherein the first compression chamber is defined between an inner circumferential surface of the fixed wrap and an outer circumferential surface of the orbiting wrap, and the second compression chamber is defined between an outer circumferential surface of the fixed wrap and an inner circumferential surface of the orbiting wrap;

a first oil supply passage that is in fluid communication with the first compression chamber; and a second oil supply passage that is spaced apart from the first oil supply passage and in fluid communication with the second compression chamber, wherein the orbiting wrap and the fixed wrap are configured to define a pressure profile in each of the first compression chamber and the second compression chamber based on a crank angle of the orbiting scroll relative to the fixed scroll, the pressure profile comprising:

a first oil supply section defined based on the first oil supply passage fluidly communicating with the first compression chamber, and a second oil supply section defined based on the second oil supply passage fluidly communicating with the second oil supply passage, an overlap section in which the first oil supply section and the second oil supply section overlap with each other, and a non-overlap section in which the first oil supply section and the second oil supply section do not overlap with each other, and wherein a range of the crank angle corresponding to the overlap section is less than a range of the crank angle corresponding to the non-overlap section.

16. The scroll compressor of claim 15, wherein the first oil supply passage is configured to fluidly communicate with the first compression chamber while the second oil supply passage is blocked from the second compression chamber.

17. The scroll compressor of claim 15, wherein the first oil supply passage comprises:

a first oil supply hole that passes through an inside of the orbiting scroll; and an oil supply guide portion defined at a thrust surface of the fixed scroll facing an end of the first oil supply hole, and wherein the oil supply guide portion is located within a virtual circle having a radius connecting a center of the fixed end plate to an outermost end of the fixed wrap.

18. The scroll compressor of claim 15, wherein the pressure profile comprises (i) a first compression ratio of the first compression chamber with respect to a reference pressure and (ii) a second compression ratio of the second compression chamber with respect to the reference pressure, and wherein the first compression ratio of the first compression chamber is greater than the second compression ratio of the second compression chamber in the overlap section.

19. The scroll compressor of claim 18, wherein the second compression ratio of the second compression chamber is greater than the first compression ratio of the first compression chamber in at least a portion of the non-overlap section within the second oil supply section.

* * * * *